US008196647B2

(12) United States Patent
Bruun et al.

(10) Patent No.: US 8,196,647 B2
(45) Date of Patent: Jun. 12, 2012

(54) METHOD AND EQUIPMENT FOR DISTRIBUTION OF TWO FLUIDS INTO AND OUT OF THE CHANNELS IN A MULTI-CHANNEL MONOLITHIC STRUCTURE AND USE THEREOF

(75) Inventors: Tor Bruun, Porsgrunn (NO); Bjørnar Werswick, Langesund (NO)

(73) Assignee: Norsk Hydro ASA, Oslo (NO)

( * ) Notice: Subject to any disclaimer, the term of this patent is extended or adjusted under 35 U.S.C. 154(b) by 1301 days.

(21) Appl. No.: 10/552,246

(22) PCT Filed: Mar. 22, 2004

(86) PCT No.: PCT/NO2004/000080

§ 371 (c)(1),
(2), (4) Date: Jun. 9, 2006

(87) PCT Pub. No.: WO2004/090451

PCT Pub. Date: Oct. 21, 2004

(65) Prior Publication Data

US 2006/0219397 A1 Oct. 5, 2006

(30) Foreign Application Priority Data

Apr. 11, 2003 (NO) ..... 20031710

(51) Int. Cl.
*F28F 3/08* (2006.01)

(52) U.S. Cl. ..... 165/167; 165/166

(58) Field of Classification Search ..... 165/164–167
See application file for complete search history.

(56) References Cited

U.S. PATENT DOCUMENTS

| | | | | |
|---|---|---|---|---|
| 2,875,986 | A * | 3/1959 | Holm | 165/165 |
| 4,149,591 | A * | 4/1979 | Albertsen | 165/165 |
| 4,271,110 | A | 6/1981 | Minjolle | |
| 4,291,754 | A * | 9/1981 | Morse et al. | 165/165 |
| 4,379,486 | A * | 4/1983 | Kurihara | 165/166 |
| 4,379,487 | A * | 4/1983 | Krakow | 165/165 |
| 4,589,480 | A * | 5/1986 | Dahlgren | 165/167 |
| 4,893,673 | A * | 1/1990 | Rosman et al. | 165/167 |
| 4,966,227 | A * | 10/1990 | Andersson | 165/167 |
| 5,492,171 | A * | 2/1996 | Kallrot | 165/167 |
| 5,725,051 | A * | 3/1998 | Veltkamp | 165/165 |
| 2002/0023740 | A1 * | 2/2002 | Lowenstein et al. | 165/166 |

FOREIGN PATENT DOCUMENTS

| | | |
|---|---|---|
| JP | 56-137092 | 10/1981 |
| WO | 03/033985 | 4/2003 |

* cited by examiner

*Primary Examiner* — Leonard R Leo

(74) *Attorney, Agent, or Firm* — Wenderoth, Lind & Ponck, L.L.P.

(57) ABSTRACT

A method and equipment for distribution of two fluids into and out of channels in a multi-channel monolithic structure (monolith) where the channel openings are spread over an entire cross-sectional area of the monolithic structure. The equipment consists of a manifold head, a monolith unit or a monolith stack, a row of monolith units or monolith stacks, or a monolith block. In addition a method and a reactor for mass and/or heat transfer between two fluids transfers the two fluids using one or more of the manifold heads and monolith units, the monolith stack, the row of monolith units or monolith stacks, or the monolith block.

18 Claims, 18 Drawing Sheets

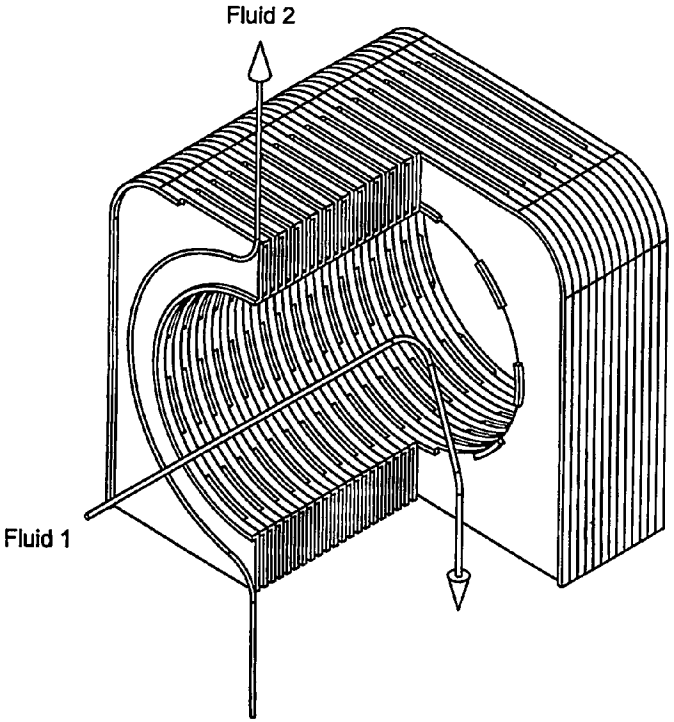
Fig. 4.1
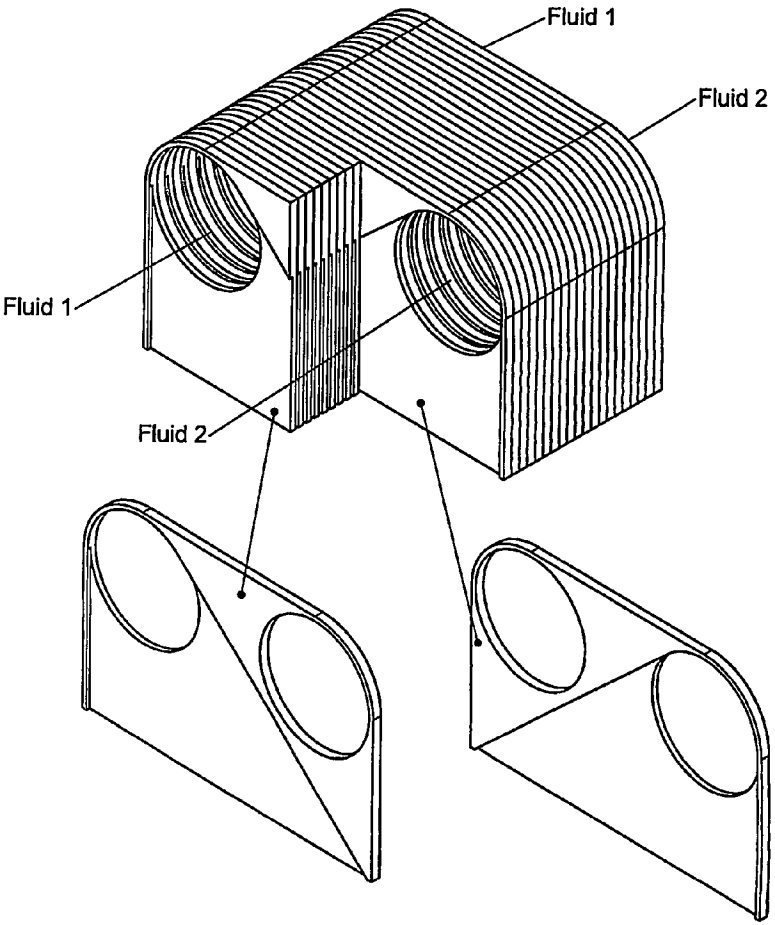
Fig. 4.2

METHOD AND EQUIPMENT FOR DISTRIBUTION OF TWO FLUIDS INTO AND OUT OF THE CHANNELS IN A MULTI-CHANNEL MONOLITHIC STRUCTURE AND USE THEREOF

BACKGROUND OF THE INVENTION

1. Field of Invention

The present invention concerns a method and equipment for distribution of two fluids into and out of channels of a multi-channel monolithic structure (monolith) where the channel openings are spread over an entire cross-sectional area of said structure.

The present invention is applicable in processes for mass and/or heat transfer between two fluids.

2. Description of the Related Art

The industrial use of monoliths is limited mainly to applications in which only one fluid flows through all the channels at the same time.

In literature identified below, a number of processes or applications are described in which monoliths can be used to improve transfer heat and/or mass between two different fluid flows. Small-scale experimental tests have also been carried out with such processes. An example of this is production of synthesis gas (CO and $H_2$). Synthesis gas is normally produced using steam methane reformation. This is an endothermic reaction in which methane and steam react to form synthesis gas. Such a process can be carried out in a monolith in which an exothermic reaction in adjacent channels supplies heat to the steam methane reformation.

Although it has been shown that it will be advantageous to use monoliths for mass and/or heat exchange between two fluids in a number of applications, industrial use of monoliths for such applications is not very widespread. One of the most important points of complaint or reasons why monoliths are not used in this area is that the prior art technology for feeding and distributing the two fluids into and out of the monolith's separate channels is complicated and not very suitable for scaling up (i.e. interconnection of several monolith units), particularly when the large number of channels in a monolith are taken into consideration.

German patent DE 196 53 989 describes a device and a method for feeding two fluids into the monolith's channels through feed pipes. These feed pipes or tubes feed the two fluids into the monolith's respective channels from the plenum chambers of the respective fluids. The plenum chambers are mounted together in such a way that tubes from the outer chamber must be fed through the inner chamber and subsequently into the monolith's channels. Each individual tube must be sealed in order to prevent leakage from the channels of the monolith and from lead-throughs in the walls of the plenum chambers. When heated, the monolith, plenum walls, pipes and sealing material will expand, and, when cooled, they will contract. This increases the likelihood of crack formation and undesired leakage with mixture of the two fluids as a consequence. This likelihood will increase with the number of pipe lead-throughs.

In DE 196 53 989, the inlet and outlet zones with the sealed pipes are cooled so that a low-temperature, flexible sealing material can be used and the risk of crack formation and leakage can be reduced. A cooling system will naturally make the monolithic structure more expensive and more complicated, particularly for applications on a large scale in which the monolith consists of many thousand channels and in which it is also necessary to use many monolithic structures in series and/or in parallel to achieve a sufficient surface area.

U.S. Pat. No. 4,271,110 describes another method for feeding two fluids in and out. This method has the advantage that pipe in-feeds from the plenum chamber to the channels of the respective fluids in the monolithic structure can be dispensed with completely. This is achieved by cutting parallel gaps down the ends of the monolith. These cuts or gaps lead into or out of the channels for one of the fluids. The gaps cut then correspond to a plenum chamber for the row of channels that the gap cuts through. By sealing the gap's opening that faces out towards the end of the monolith, openings are created in the sidewall of the monolith where one of the fluids can enter or leave. The other fluid will then enter or leave at the short end of the monolith in the remaining open channels. A major disadvantage of this method, apart from the necessary processing (cutting and sealing) of the monolithic structure itself, is that only half of the available area for mass and/or heat exchange can be utilized. For example, square channels for one fluid and the other fluid will have to lie in connected rows so that the channel structure for the two fluids corresponds to a plate heat exchanger. If the channels for the two fluids were distributed as in a chessboard pattern, where the black fields correspond to channels for one fluid and the white fields correspond to channels for the other fluid, the maximum utilization of the area could be achieved because, in such a fluid distribution pattern, all the walls of the channels for one fluid would be joint or shared walls with those of the other fluid. With fluid channels for the same fluid in a row as in U.S. Pat. No. 4,271,110, roughly only half of the channels' walls will be in contact with those of the other fluid.

BRIEF SUMMARY OF THE INVENTION

The two fluids will normally be two gases with different chemical and/or physical properties. But the present invention is also applicable when one fluid is a gas and the other is a liquid. One can even have systems where one or both fluids is a mixture of gas and liquid. This gas liquid mixture can constitute a continuous or homogeneous phase or a distinct two-phase flow (slug flow). In the following description the two fluids are exemplified by the name of fluid 1 and fluid 2.

Fluid 1 and fluid 2 are fed into said channels for fluid 1 and said channels for fluid 2 respectively. Fluid 1 and fluid 2 are distributed in the monolith in such a way that they have joint walls separating fluid 1 and fluid 2. The walls that are joint walls for the two fluids will then constitute a contact area between the two fluids that is available for mass and/or heat transfer. This means that the fluids must be fed into channels where the channel openings are spread over the entire cross-sectional area of the monolith. The present invention makes it possible to utilize the entire contact area or all of the monolith's channel walls directly for heat and/or mass transfer between fluid 1 and fluid 2. This means that the channel for one fluid will always have the other fluid on the other side of its channel walls, i.e. all adjacent or neighboring channels for fluid 1 contain fluid 2 and vice versa. The present invention is particularly applicable for process intensification because monolithic structures with channel openings that have a small cross-section area (i.e. channel openings with 1-6 mm width) and thin walls can be utilized. Channels with small cross-section area and thin walls give large surface area per volume unit and thus a very compact and energy-efficient device for heat and or mass transfer.

In the present invention the contact area wall in the monolith can be a membrane capable of selectively transporting one or more components between the two fluids. Furthermore the present invention can also be utilized for two-phase flow systems where gas and liquid is transported within the same channel (here fluid 1) and perform internal mass transfer (absorption or desorption) between the two-phases (gas and liquid) simultaneously as being heated or cooled by fluid 2 through the contact area wall.

The wall between the two different fluids can also consist of active surface components on one or both sides. Such active surface components or catalysts are used when one or more chemical reactions are involved. Often chemical reactions produce or consume heat (exothermic and endothermic reactions). To optimize such reaction systems temperature control is of great importance.

A characteristic feature of multi-channel monolithic structures (monoliths) is that they consist of a body with a large number of internal longitudinal and parallel channels. The entire monolith with all its channels can be made in one operation, and the production technique used is normally extrusion.

By using extrusion technology for production of a monolithic structure, there is great opportunity to influence the geometric shape of the channels. Extrusion as a production method means that the entire monolithic structure can be made in one operation. The channels' cross-sectional area may differ in both shape and size or can be made uniform in size and shape, which is most common, for example triangular, square or hexagonal. However, combinations of several geometric shapes are also conceivable. The geometric shape, together with the channel opening width or area, will be significant for the mechanical strength and available surface area per volume unit.

The width of the channel openings are typically in the order of 1-6 mm in size, and the wall thickness is normally 0.1-1 mm. A multi-channel monolithic structure with channel opening width of the smallest sizes stated achieves a large surface area per volume unit. The typical values for said surface area per volume unit will be in the range of 250 to 1000 $m^2/m^3$. Another advantage of monoliths is the straight channels, which produce low flow resistance for the fluid. The monoliths are normally made of ceramic or metallic materials that tolerate high temperatures. This makes them robust and particularly applicable in high-temperature processes.

In industrial or commercial contexts, monoliths are mainly used where only one fluid flows through all the channels in the monolith. The channel walls in the monolith may be coated with a catalyst that causes a chemical reaction in the fluid flowing through. An example of this is monolithic structures in vehicle exhaust systems. The exhaust gas heats the walls in the monolith to a temperature that causes the catalyst to activate oxidation of undesired components in the exhaust gas.

Monolithic structures are also used to transfer heat from combustion gases or exhaust gases to incoming air for combustion processes. One method involves two gases, for example a hot and a cold gas, flowing alternately through the monolith. With such a method, for example, the exhaust gas can heat up the monolithic structure and subsequently emit heat to cold air. Such regenerative heat exchange processes with cycles in which there is alternation between two fluids (one hot, one cold) in the same structure is not, however, suitable where mixing of the two fluids are undesirable or where stable and continuous heat and/or mass transfer is desired.

The main object of the present invention was to arrive at a method and equipment for feeding and distributing two fluids into and out of a multi-channel monolithic structure in which maximum surface area utilization is achieved.

Another object of the invention was to arrive at an improved method and reactor for mass and/or heat transfer between two fluids.

In accordance with the invention the first object is accomplished in a method in that one fluid is fed through a slot in one or more gaps in a manifold head, which is sealed to one face of said monolith structure, the other fluid is fed into a tunnel in said manifold head and further through slots in said tunnel wall and into one or more gaps in said manifold head. The fluids are distributed from their respective gaps into said channels in such a way that at least one channel wall is in common for said fluids, and said fluids are collected in their respectively gaps in a manifold head which is sealed at the opposite side of said structure where the first manifold head is sealed. The fluids are then respectively led through a slot from one or more gaps and slots in a tunnel wall in said last mentioned manifold head.

In accordance with the invention, the first object is accomplished by a manifold head in that said manifold head comprises at least three parallel dividing plates joined together with spacers to form gaps with slots between said plates and end cover plates joined in parallel to said dividing plates where said dividing plates and cover plates have one opening forming a tunnel with slots through said joined plates.

In accordance with the invention, the first object is accomplished by a multi-channel monolithic structure where the channel openings are spread over the entire cross-sectional area of said structure and said channels have joint walls and said manifold head which is sealed to at least one face of said structure.

In accordance with the invention, the first object is accomplished by a stack in that said stack comprises two or more multi-channel monolithic structures where the channel openings are spread over the entire cross-sectional area of said structures and said channels have joint walls, at least one of said manifold head which is sealed to at least one face of said structure, at least one plate with holes which is sealed between said manifold head and said structure on said side where the channel openings are, and at least one connector plate or other coupling device between units.

In accordance with the invention, the first object is accomplished by a row in that said row comprises said units or stacks coupled together.

Typically the length of the row is in the same order of magnitude as the height of the individual stack to fit into a cylindrical shell.

In accordance with the invention, the first object is accomplished by a block in that said block comprises rows of said units or stacks which are stapled face to face.

The block has the same height as the individual monolith stack, with the same width as the row and the block length proportional with the number of rows.

In accordance with the invention, the second object is accomplished by a reactor in that one or more of said units or stacks or said row of units or stacks or said blocks are integrated in said reactor.

The pressure vessel contains the monolith block (the monolith structures packed closely together) with hollow spaces, ducts, channels or pipes within shell transporting one or both fluids into and out of the monolith structures as well as in and out of the pressure vessel.

In accordance with the invention, the second object is accomplished by a method in that said two fluids are distributed through one or more of said units or stacks, or row of units or stacks, or blocks.

Between the manifold head and the monolith one or more plates with holes for the fluids are fitted in to ensure even flow distribution and transformation of fluid flow between chessboard pattern (in monolith) and linear pattern (in manifold head).

The present invention makes possible to connect two or more monolithic structures through a flexible coupling integrated in the manifold head. If it is required to connect several such units together, it is essential that they can move relative to each other because of differences in thermal expansion. A number of monolith structures coupled together constitute a monolith TOW.

Furthermore, the present invention makes possible to arrange a large number of monolithic structures within a pressure vessel without increasing the diameter of the pressure vessel when increasing the number of monolith structures. The system capacity can thus be decreased/increased simply by changing number of rows or number of monolith structures and adjusting length of pressure vessel.

The present invention also makes possible to allow one fluid to be kept in a tubular, closed system, i.e. a pipe, and the other fluid to flow in and out from hollow spaces within a pressure vessel.

If the present invention is used, it is not necessary to have cuts as described in U.S. Pat. No. 4,271,110 or pipe in-feeds as described in DE 19653989 C2.

The present invention grants users the freedom to use all types of shape and size and the opportunity to utilize the maximum available surface area for heat and/or mass exchange. The method described in U.S. Pat. No. 4,271,110 requires that all channels with the same fluid share at least one wall so that when the shared wall is removed or machined away, a connecting gap will be created that will constitute a joint plenum chamber for the fluid. The fact that two neighboring channels with the same fluid must have at least one joint channel wall means that the available heat and/or mass exchange area is reduced. In DE 19653989 C2, pipes are used that are fed from the plenum chambers of the respective fluids into the monolith channels, which can be distributed in such a way that the maximum available area can be utilized, i.e. the fluids are fed in distributed in such a way that one fluid always shares or has joint channel walls with the other fluid. The two fluids are distributed in the channels corresponding to a chessboard pattern. This produces maximum utilization of the available mass and/or heat exchange area.

The present invention consists of a method and equipment that can, in an efficient manner, feed and distribute two different fluids into and out of their respective channels in a multi-channel monolithic structure. It is necessary that the channel openings for the two fluids are evenly distributed or spread over the entire cross-sectional area of the monolith and that the channels have joint walls. The equipment will, in an efficient, simple manner, collect the same type of fluid, for example fluid 1, from all channels containing this fluid in an inlet or outlet so that fluid 1 can be kept separate from fluid 2 and vice versa.

Moreover, the fewest possible number of parts or components and the least possible processing and adaptation of these parts or components and the monolith will be favorable with regard to robustness, complexity and cost. In principle, it is true to say that the fewer individual components or parts, the greater the advantage achieved. This contributes to simplifying the sealing between the two fluids that are to be fed into and out of the monolith's channels. The possibility of parallel fabrication of manifolds head, hole plates and the monolith structures will reduce processing time. Pre-assembling these components into a monolith unit, a monolith stack, a row of units or stacks or a monolith block will further be very advantageous for installation within a pressure vessel.

Moreover, it may be favorable to achieve the largest possible contact area (surface area) in a monolith with a given channel opening width. This will be particularly advantageous if the monolithic structure or channel walls are used as a membrane, for example hydrogen or an oxygen transporting membrane.

To achieve the largest possible transport capacity of the relevant fluid component per volume unit of the monolithic structure, it will be important to have the largest possible contact area per volume unit. It is therefore desirable for the fluid that flows in one channel to have the other fluid on all sidewalls that make up the channel. Using channels with a square cross-section as an example, the two fluids must flow through the monolith in a channel pattern corresponding to a chessboard, i.e. one fluid in "white" channels and the other fluid in "black" channels. In addition to being very significant for mass transfer between two fluids, the largest possible direct contact area will also be important for heat transfer efficiency.

The smaller the channel openings are, the larger the specific surface area in the monolith will be. To achieve compact solutions, it will therefore be desirable to have as small channels as practically possible.

At those faces of the monolith, where the monolith's channels have their inlets and outlets, a manifold head is sealed over the monolith's channel openings. For some applications, it may be necessary to seal just one face of the monolith with a manifold head. The manifold head comprises dividing plates fitted at a distance adapted to the channel opening size in the monolith. The distance or space between the plates collects fluid from the channel openings that lie in the same row (i.e. same fluid) in the monolith. This space is called the plenum gap. In one application these dividing plates have a hole (e.g. circular hole) such that one of the fluids can be led out of or in to the tubular space formed by said dividing plates. This tubular space can be connected to a tube or pipe. Thus, if the monoliths are arranged within a pressure vessel, one of the fluids can be kept in a closed piping system connected to the tubular space of the manifold head, and the other fluid can be allowed to flow in the open space and/or via guiding ducts to the inlet and outlet openings of the manifold head in said vessel. With such a system one avoids a direct (sealed) connection to the monolith for one of the fluids.

The rows of the channel openings preferably run transversely over the entire short end of the monolith and comprise either inlet or outlet for the same fluid. These rows of fluid channel openings with the same fluid are kept separate by the sealed dividing plates in the manifold head. The two fluids will then be collected in their respective plenum gaps. With rows of channel openings for the same fluid, the plenum gap for one fluid will have the plenum gap for the other fluid on the other side of the dividing plate. In a monolith with square channels in which the same fluid is arranged in rows, the dividing plates will have to be sealed to the channel walls in the monolith. Instead of sealing the dividing plates directly to the channel walls in the monolith, one plate may alternatively first be sealed to the short face of the monolith. Said plate is a plate with holes (hole plate) through which the channel openings in the monolith lead out, i.e. so that fluid from the various channels that contain the same fluid can be fed out through the holes in said plate and into the plenum gaps. This means that the dividing plates in the manifold head are sealed to the hole plate between the rows of holes instead of directly to the monolith's channel walls that separate the two fluids.

By sealing a hole plate to one or both faces of the monolith with openings adapted for fluid 1 and fluid 2, the manifold head described can be used where the channels for fluid 1 and fluid 2 are distributed in a chessboard pattern in the monolith. This represents a method and equipment for feeding two separate fluids in and out that enable maximum utilization of the surface area in the monolith. The fluids will be transferred from a chessboard distribution pattern in the monolith to rows of holes in the plate sealed to the monolith. Moreover, fluid 1 and fluid 2 will be fed from these rows of holes out of or into the monolith's channels where fluid 1 and fluid 2 are distributed as in a chessboard pattern with one fluid in the "black" channels and the other fluid in the "white" channels. The hole plate allows fluid distributed in a chessboard pattern to be fed out into plenum gaps divided by dividing plates that can separate fluid 1 and fluid 2 from each other. The plate's holes must have a slightly smaller opening area than the channel openings to which they are sealed. In addition to a reduced outlet area in relation to the channel area, the openings in the plate that is sealed to the monolith's channel structure and the dividing plates in the manifold head must also be designed and located so that the distance between the holes that lead into or out of the two fluids' channels is such that it is possible to place the dividing plates between the rows of holes with inlets and/or outlets for the same fluid. Using the example of square channel openings in which the two fluids are distributed as in a chessboard pattern, the dividing plates between the two fluids will follow the straight line between the rows of holes with the same fluid.

It is now possible to have two fluids distributed in channels in a monolithic structure out of or into separate plenum gaps where the channel openings are distributed in a chess board pattern. In order to be able to keep the two fluids separate when they enter or leave the plenum gaps in the manifold head, the same fluid can be fed to openings in the plenum gaps in a side edge of the manifold head, and, correspondingly, all plenum gaps for the other fluid are led out on the opposite side edge of the manifold head to the first fluid. Alternatively one of the fluids can be lead in and/or out from the plenum gaps to a tubular space in the dividing plates and then connected or coupled to a pipe or to a circular connection or joint to a neighboring manifold head of a monolithic stack. Such a coupling or joint between manifold heads makes it possible to stable or arrange several monolithic units or stacks in rows. Such a row can then again be stapled close to an adjacent row. Thus, the monolith units can be arranged close together enabling compact solutions of multiple monolithic stacks into a monolith block or core within a pressure vessel.

In a system in which there is not only a single hole plate that feeds the fluid from each channel through the holes in said plate and directly out into the manifold head's plenum gaps (the space between the dividing plates in the manifold head), but a system of two or more plates, the distance between the dividing plates in the manifold head can be made far larger than the channel openings in the monolith and thus not limited by the cross sectional area (width) of the monolith channels.

This is done by feeding the fluid from one channel over into the flow from the neighboring channel through channels or funnels created inside the hole plate system between the monolith and the manifold head. Fluid from one or more neighboring channels in the monolith must then be fed out through a joint outlet to the plenum gaps in the manifold head. These joint outlets/inlets are arranged in a system so that outlets for the same fluid are gathered together and, correspondingly, the outlets for the other fluid are also gathered together. These collections of outlets for the same fluid are gathered together so that they create a pattern that causes the dividing plates in the manifold head to have a much greater distance from each other than if the plates were sealed directly to the manifold head, where the width of the individual channel openings in the monolith would determine the distance.

The most efficient heat transfer per volume unit of monolithic structure is achieved with small channels and fluid distribution in a chessboard pattern. This can utilize almost 100% of the available surface area in the monolith. The smaller the channels, the larger specific surface area per volume unit becomes. Small channel opening width however, will also make it more complicated to feed the fluids out/in through the manifold head to or from the monolith's channels. A hole plate system as described above will simplify the feeding into and out of the small channels and will allow fluid distribution in a check pattern to be retained.

In the following, a system is described for feeding two different fluids into and out of monolithic structures without use of a manifold head. The method is based on the fluid channels with the same fluid being arranged in rows in which they share joint walls. In a similar manner to that described in U.S. Pat. No. 4,271,110, these joint walls can be cut away at a certain depth of the monolith and subsequently be sealed at the end so that openings are created in the sidewalls of the monolith where one of the fluids can be fed in or out.

However, unlike the method described in U.S. Pat. No. 4,271,110, this method is based on the fluid channels in rows not only running in parallel along the side walls in one direction but a row pattern being formed in both directions (perpendicular to each other). This means that the cuts are made for these intersecting rows, and, after sealing (as described above), the result will be openings in all four side walls of the monolith and not just in two side walls, which is the case when the rows only run in parallel in one direction. This produces greater flexibility for feeding the fluids in and out of the monolith. It will then be possible to arrange the fluid channels in repeating units of 3×3 with one fluid in the corner channels and the other fluid in the two centrally intersecting rows (cross). Similarly, it will be possible to have a repeating unit of 4×4 channels in which the centrally intersecting connected rows form a cross. The six other channels are then also placed with one in each corner (the top of the cross) and two in the corresponding outer edges on each side at the bottom of the cross.

The present invention makes it possible, in a simple and efficient manner, to feed and distribute two different fluids out of and into individual channels in a multi-channel monolithic structure. This is done by means of a manifold head that is sealed to the short face or the faces of the monolith where the channel openings are. The method is based on utilizing the system in the monolith where channel openings that feed the same fluid are in rows when the two fluids are evenly distributed. The rows of channel openings with the same fluid lead to plenum gaps in the manifold head. The plenum gaps may also be arranged with openings so that the two different fluids can be fed out on either side of the manifold head. This means that we can have separate fluid flows out of or into the individual channels in the monolith from separate plenum gap (i.e. the space formed between two dividing plates). This means that it is not necessary to use pipes to feed the two fluids into or out of the monolith or to make cuts or gaps in the monolith itself. Moreover, it will be possible to stack several monoliths in parallel, i.e. side surface against side surface, and thus feed the fluids out of and/or into an external container through channels formed by inclined walls on the manifold heads. The plenum gaps may also be arranged with slots so that the one of the fluids can be fed in or out on top or on one or both sides of the manifold head while the other fluid is fed in or out from plenum gaps through slots to a tubular space in the manifold head. This means that we can have separate fluid flows out of or in to the individual channels in the monolith from separate plenum gaps (i.e. the space formed between two dividing plates) were the plenum gaps for one of the fluids lead into a tubular space connected to a pipe or circular duct connection.

Moreover, the present invention will make it possible, in the same way as described above, with the stated manifold heads, to distribute two fluids in fluid channels in a chessboard pattern into and/or out of a multi-channel monolith, i.e. with one fluid in the "black" channels and the other fluid in the "white" channels.

If the manifold head is connected directly to the monolith, then the distance between the dividing plates in the monolith head will have to be smaller than the channel openings in the monolith. The lower limit of the distance between the dividing plates will therefore determine how small the channel openings may be that are made in the monolith. A system of hole plates between the monolith and the manifold head will make it possible to feed the fluids into and out of the channels in the monolith that have a size that is much smaller than the distance between the manifold head's dividing plates. In addition, this hole plate system will also make it possible to arrange the fluid channels, which are distributed in a check pattern, in a pattern in which the outlet channels for the same fluid are in one row.

Moreover, a hole plate system between the monolith and the manifold head will make it possible to have a greater distance between the dividing plates than the channel openings in the monolith.

A distribution of the fluid channel openings in a chessboard pattern enables a maximum utilisation of the contact area between the two fluids in the monolith. A plate that covers all the channel openings is sealed to a face of the monolith and to the manifold head. The plate also has a hole pattern equivalent to the channel pattern in the monolith. The channel pattern in the monolith and the hole pattern in the plate are adapted so that holes for the same fluid can form rows of holes over which the plenum gaps are placed.

The present invention requires no processing of the monolith itself if the surface roughness at the channel opening faces meets the tolerance deviation requirements for sealing of the hole plate to the monolith's channel opening faces. If this is not the case, the invention will be usable if the monolith's surfaces are processed, for example surface-ground, to the tolerance deviation requirements for sealing of the hole plate to the channel opening faces.

Through the rows of holes of one fluid in the plate, the fluid is fed in or out through plenum gaps in that which now constitutes a manifold head and out or in through slots in the same manifold head. Accordingly, the other fluid is fed in or out through slots on the opposite side wall of the manifold head or through a tubular connection. The two fluids are thus fed out of their respective channels in the monolith in such a way that the two fluids can be relatively easily kept apart.

BRIEF DESCRIPTION OF THE DRAWINGS

FIG. 4.1 illustrates a section view of the manifold head with arrows indicating fluid flow direction;

FIG. 4.2 illustrates a manifold head similar to that illustrated in FIG. 4.1, except there are two tubular openings inside of the manifold head;

DETAILED DESCRIPTION OF THE INVENTION

The present invention is explained and illustrated in further detail with reference to FIGS. 1-18.

FIG. 1

Figure 1:
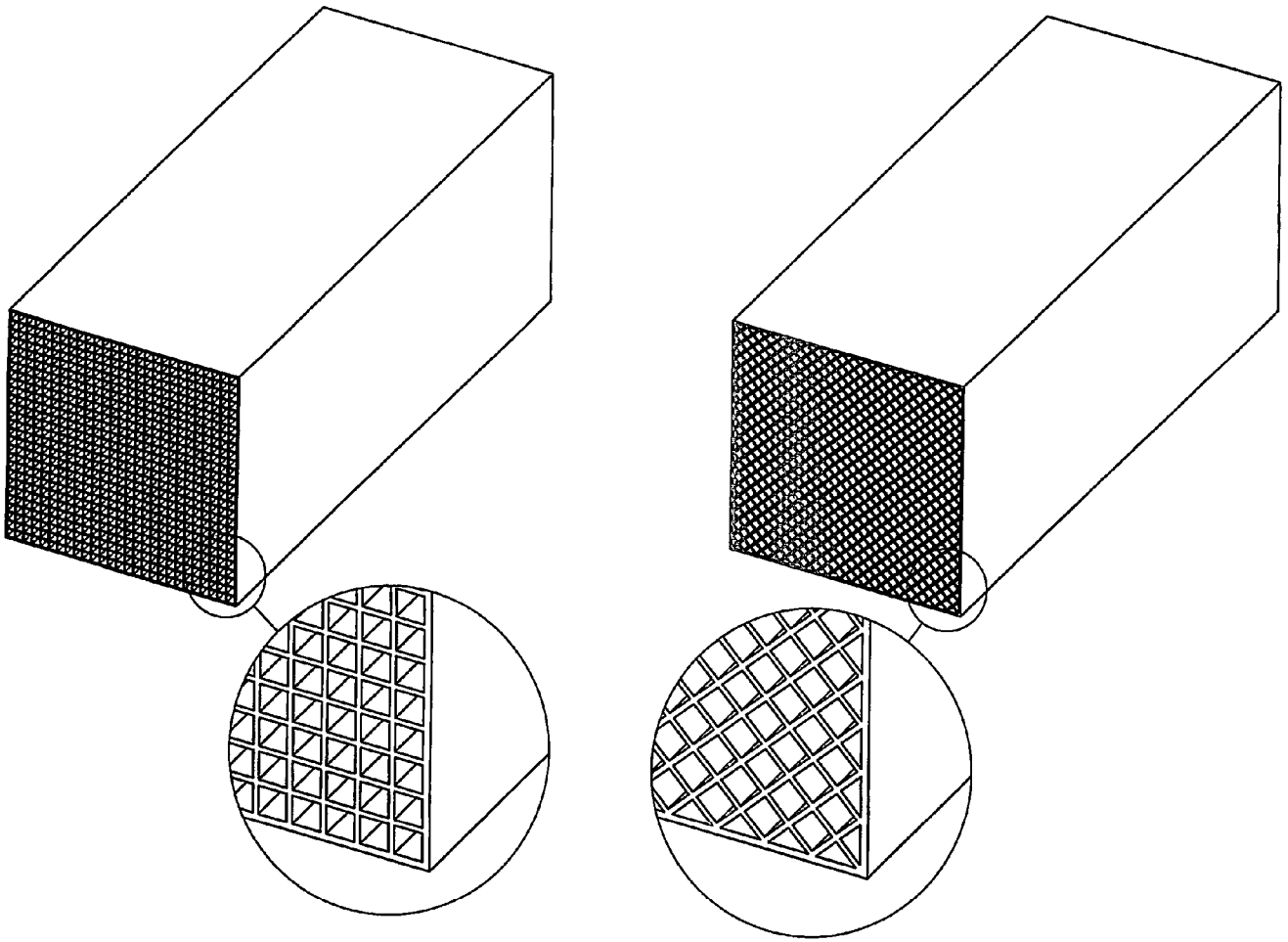
FIG. 1 illustrates two multi-channel monoliths.

FIG. 1 shows two multi-channel monoliths, both with square cells or channel openings. The monolith on the left hand side has channel walls oriented in parallel with the monolith walls. The monolith on the right hand side has channel walls oriented in 45 degrees angle to the monolith outer walls. Such monolith structures, if made of ceramic materials, will normally be made by means of extrusion. This figure presents the monoliths in perspective from one face showing the channel openings with an exploded view showing the channel details. The extrusion tool determines the monolith's channel structure, cross-section area and shape. A number of different geometric shapes of channels can be made. For example, all the channels cross-section can be triangles, squares or hexagons or there can be combination between these. The channels in a monolith will normally be parallel and uniform in shape along the entire longitudinal direction of the monolith. Monoliths with square channel openings where the channel opening walls are parallel to the sidewalls of the monolith are most common. Monoliths with channel opening walls that are oriented in 45 degrees angle to the outer walls are more unusual. In the present invention such an orientation is preferable because it simplifies the hole pattern and reduce the needed number of hole plates compared to the monolith with channel opening walls parallel with the outer monolith wall.

FIG. 2

Figure 2:
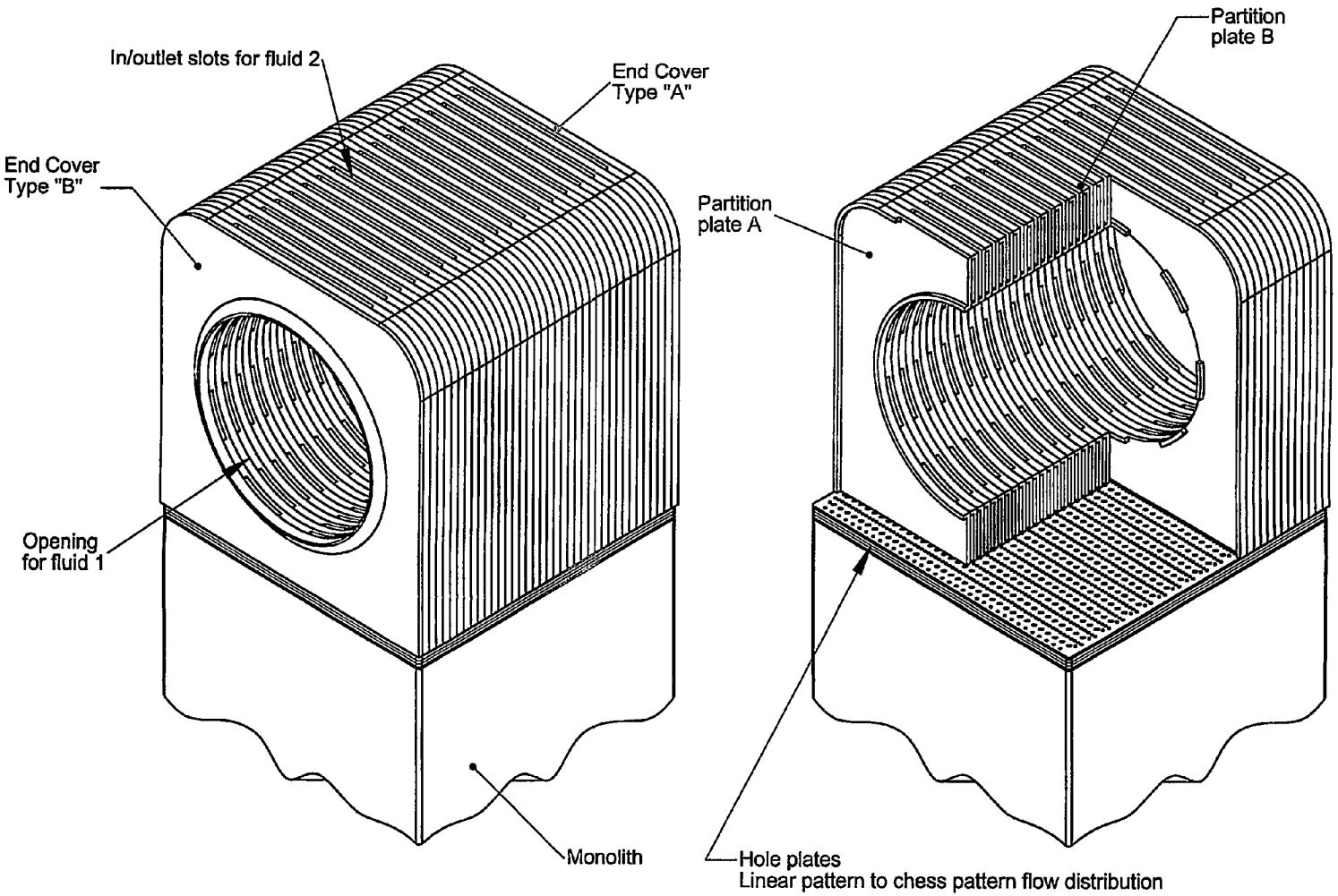
FIG. 2 illustrates an assembly of a monolith with hole plates and a manifold head.

FIG. 2 displays an assembly of a monolith with hole plates and manifold head. A typical monolith stack or monolith unit will have two such manifold heads at the two monolith faces where the inlet and outlet openings of the channels are located. By means of the hole plates fluid flow system is transformed from linear arrangement in manifold head to chessboard pattern arrangement in monolith or vice versa.

The manifold head is built up by a set of dividing plates (partition plate A and partition plate B) and two end covers (type "A" and type "B"). As can bee seen from this figure, fluid 1 can enter or leave through tubular openings inside the manifold head. In FIG. 2 the tubular openings are in the center position of the manifold head, but in principle any position within manifold head can be used. Also the shape of the manifold head is flexible besides the face that fits to the converter plates or directly to the monolith faces where we find the inlet and outlet openings of the channels. The tubular opening makes it possible to connect to a neighboring monolith stack with a similar manifold head through a tubular connection or connect manifold head to a collecting pipe for a number of monolith stacks. Thus, fluid 1 can be fed in and out through a closed piping system to and from a number of monoliths while the other fluid enter or leave through opening slots in the manifold head. Such a solution is advantageous for a system where the monolith stacks are placed inside a pressure vessel because only one of the fluids (here fluid 1) needs to be hermetically sealed where the other fluid (here fluid 2) is allowed to fill empty space in pressure vessel and flow through ducts or channels to or from inlet and outlet openings in the vessel shell.

The first hole plate seals to the monolith faces where we find the inlet and outlet openings of the channel have openings (holes) that correspond to the number of channel openings in the monolith. The holes are arranged with openings that are positioned above the monolith channel opening such that two fluids can flow from monolith channels to the gap between the dividing plates in the manifold head and vice versa. For the functionality of the system the openings for one fluid in the plate sealed to the monolith (arranged in chess pattern for maximum area utilization) must be led through a set of connected openings in a set of connected plates that change position of the fluid flow in such a way that the same fluid is led out through a linear pattern of openings that fits within the openings between the partition plates that is for the same fluid.

FIG. 3

Figure 3:
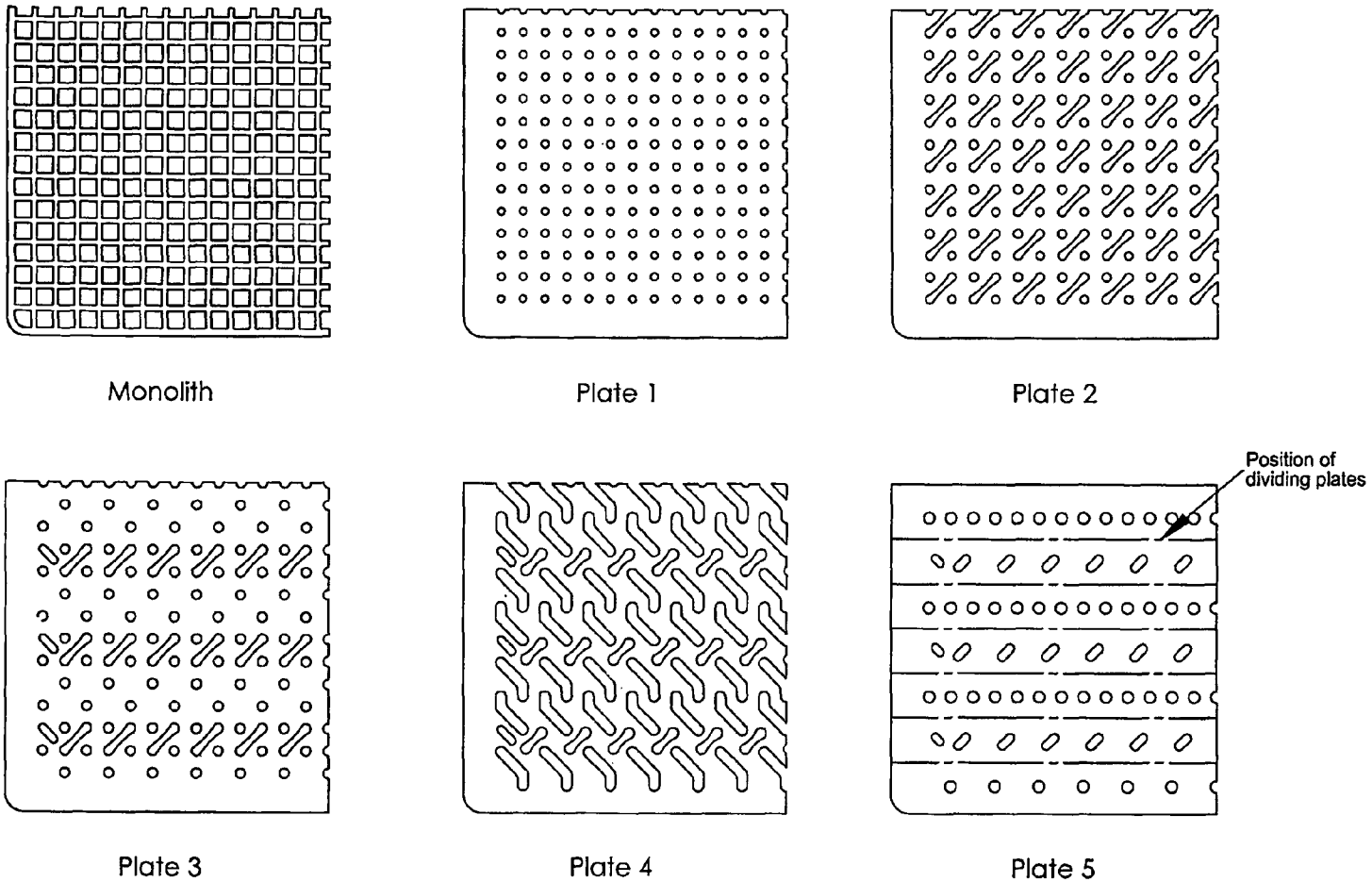
FIG. 3 illustrates the front view of one monolith with channel openings together with five hole plates.

FIG. 3 shows the front view of one monolith with the channel openings together with five hole plates. Plate 1 has holes with a pattern that is made in such a way that each hole has a position that correspond with the position of one channel opening in the monolith. When plate 1 is placed above the monolith in correct position each hole should correspondingly fit within a monolith channel opening. Plate 1 can be sealed to the monolith in this position. The diameter of the holes in plate 1 is most preferable to be somewhat smaller than the width of the channel openings. How much smaller depends on tolerances and pressure drop that can be accepted, wherein tolerances mean the deviation in shape and size that can arise during production. For ceramic materials one of the reasons for deviations is the shrinkage that arises during sintering of the material. Smaller holes give larger tolerances and larger deviations can be accepted. On the other hand smaller openings in plate 1 will give a larger pressure drop for a fluid flowing therethrough. Plates 2, 3 and 4, which are the middle plates, have holes with longitudinal shapes. These shapes ensure that the fluids can change position from a chess flow arrangement in the monolith to a linear flow arrangement when led out through the holes in plate 5. The stapled lines show the position of the dividing plates of the manifold head. The fluid converter system managed through holes in the plates can also be made with fewer plates or even with one plate. If made up with one plate, then a production technique is needed that enables making small channels leading the outlet or inlet fluid to the correct position, that is, either the openings corresponding to the monolith or to the openings corresponding to the position between the partition plates. Injection moulding can be such a method, but very strong demand is put on the technique due to the small tolerances given by the very narrow channels with small distances between each other. It is possible that at least making plate 1 and plate 5 as individual plates gives better control as they can be sealed directly to monolith and partition plates.

FIGS. 4.1 and 4.2

FIG. 4.1 shows a section view of the manifold head with arrows indicating fluid flow direction. The fluids are fed into or out from the monoliths through slots that allow fluid 1 to enter from the circular opening ("tunnel") to the enclosed space (gap) between the dividing plates that separate fluid 1 from fluid 2. As illustrated, the dividing plates for fluid 2 have no opening into the circular space, but opening slots on top of the manifold head and thus fluid 2 can enter through these slots. Thus, fluid 1 and fluid 2 can come from and be let into separated plenum chambers or gaps between the dividing plates. The openings from the circular space for fluid 1 are made because the dividing or partition plate B has a set of bosses near the circular opening, which will increase the ability of the dividing plates to withstand pressure differences and allow a transfer of axial force required for a sealing ring if two or more manifold heads are coupled together.

FIG. 4.2 shows a manifold head of same system as illustrated FIG. 4.1, but with two tubular openings inside of the manifold head. With such a system, both fluids can be fed in and out from the monolith in a hermetically closed or sealed piping system. The monolith structures can then be kept in an insulated vessel at atmospheric conditions, even if both fluids are at elevated pressures. The disadvantage is that movement due to thermal expansions is restricted by the tubular connections of both fluids.

FIG. 5

FIGS. 1-4 deal with an individual system of one monolith with its manifold head.

Figure 5:
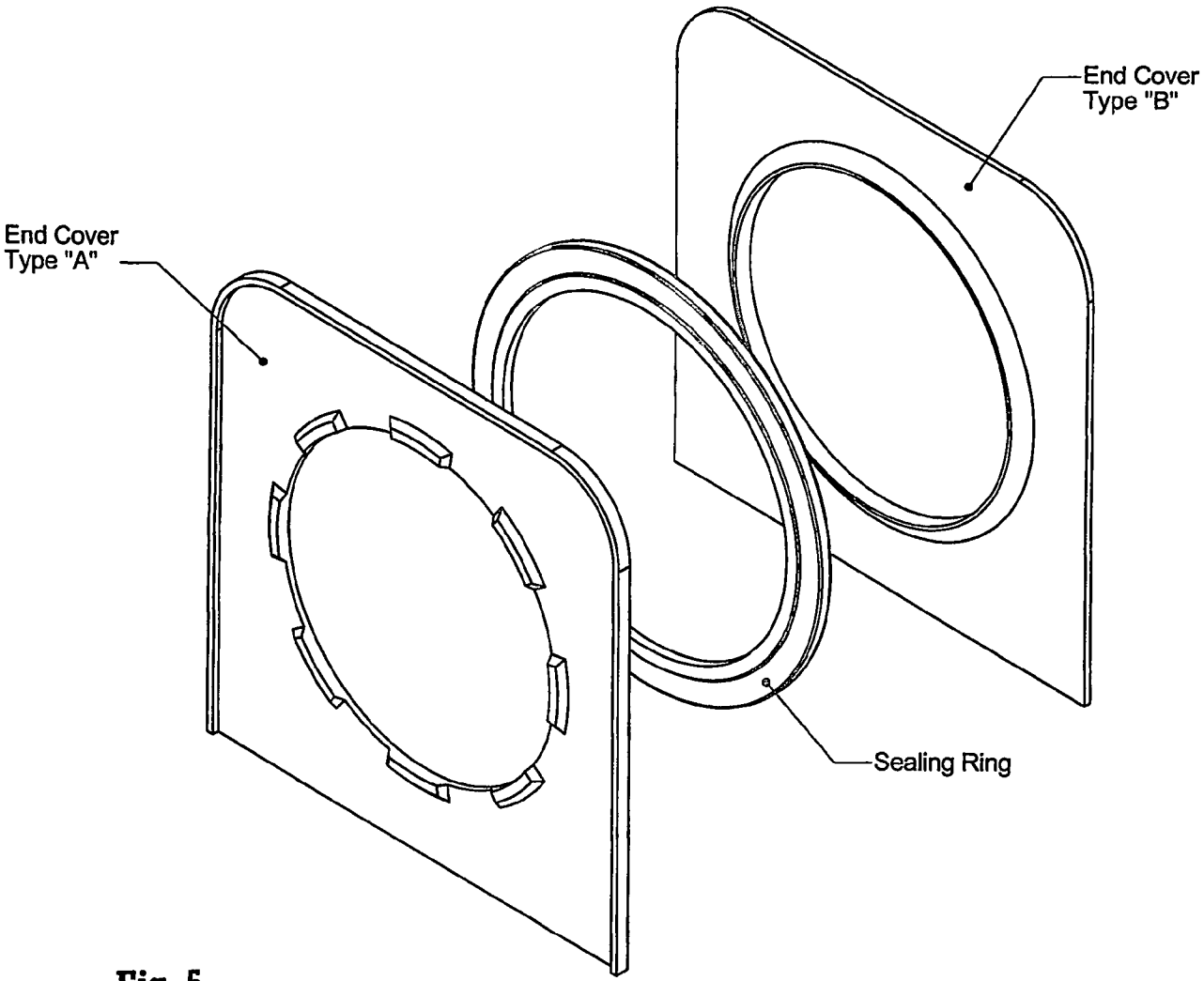
FIG. 5 illustrates a system for coupling two or more monolith stacks.

FIG. 5 shows a system for coupling two or more monolith stacks. By means of a sealing ring, an end cover type "A" from one manifold head and an end cover type "B" from another manifold head and an axial force, two monolith stacks can be coupled together (see FIG. 6). Such a system is applicable in industrial processes were often a large number of monoliths is needed.

FIG. 6

Figure 6:
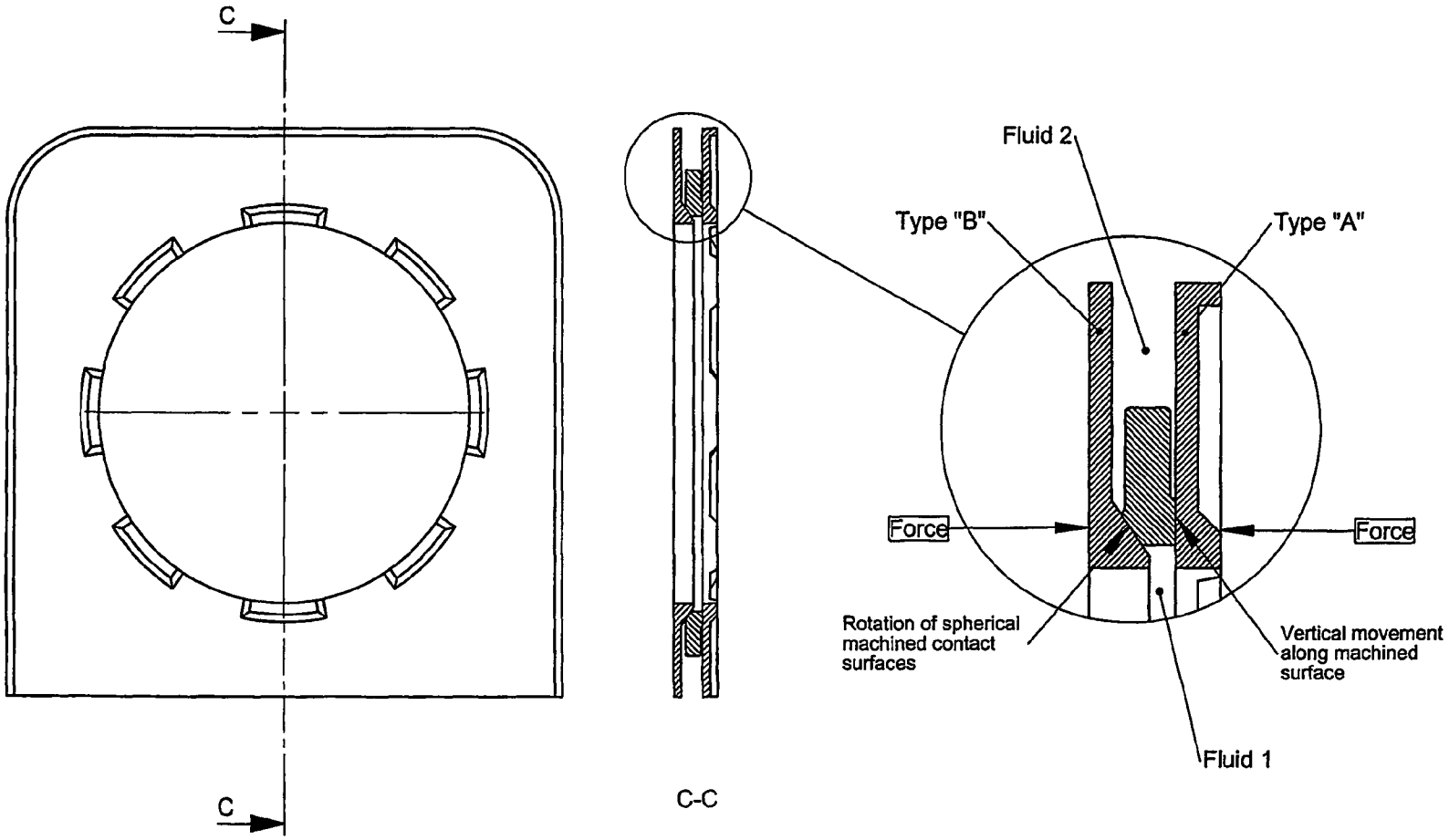
FIG. 6 illustrates a coupling principle between two manifold heads.

FIG. 6 illustrates the coupling principle between two manifold heads, showing sealing ring and two types of end covers, type "A" and "B". The contact surface between the sealing ring and end cover "A" is a plane surface that permits 2-axis movement on the surface. The contact surface between the sealing ring and end cover "B" is a part of a spherical surface that permits rotation around the center of the sphere. Note the external force that is applied to the manifold head. This force is necessary to make the system gastight, especially if "Fluid 1" has higher pressure than "Fluid 2". If "Fluid 2" has sufficient overpressure compared to "Fluid 2", then an external force should not be necessary.

The circular exploded view in FIG. 6 shows the sealing ring and the two different types (type A and B) of end covers used to connect manifold head of one monolith stack with manifold head of another neighboring monolith stack. With such a system one can do the coupling of two different monoliths in such a way that both fluid tightness and flexibility in movement can be maintained. Another aspect is that with such a system the coupling of the two monolith stacks can be done in a very compact way. The only distance is the required thickness of the sealing ring.

FIG. 7

Figure 7:
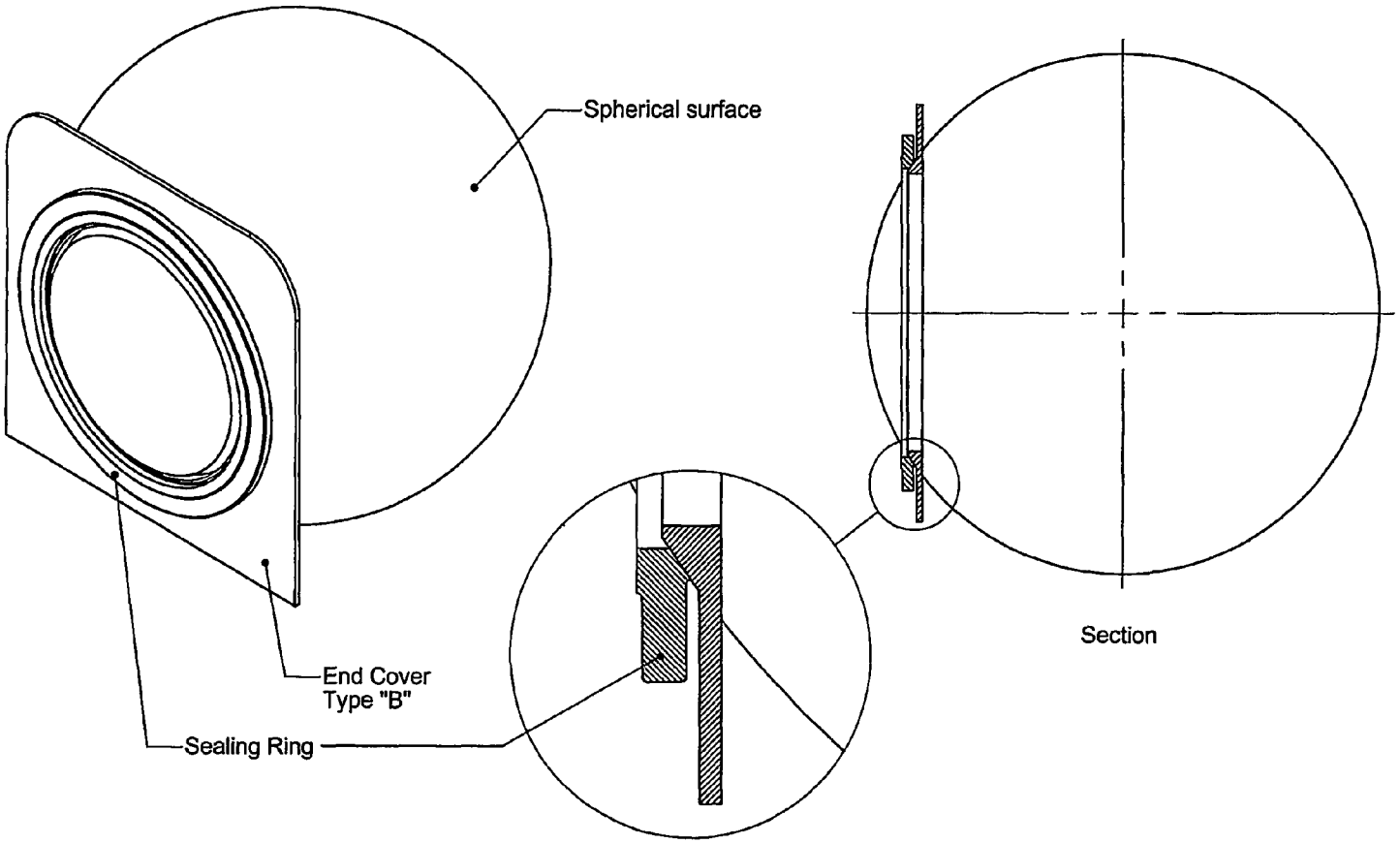
FIG. 7 illustrates a spherical contact surface between a sealing ring and end cover "B"

FIG. 7 explains the spherical contact surface between sealing ring and end cover "B". This figure shows how the contact surface between the sealing ring and end cover "B" is a part of a spherical surface that permits rotation around the center of the sphere.

FIG. 8

Figure 8:
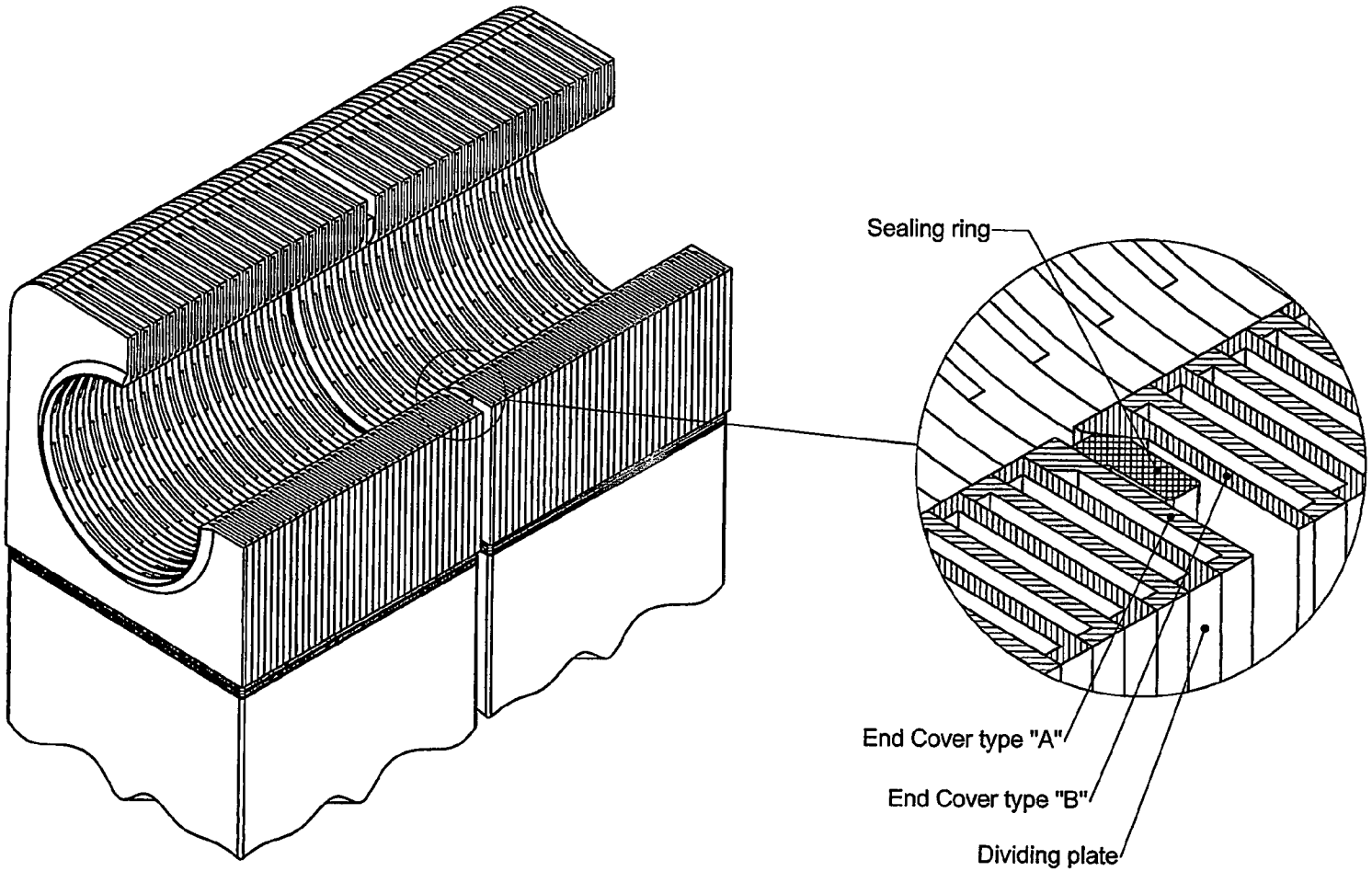
FIG. 8 illustrates an assembly with two monoliths and a manifold system connected to one another.

FIG. 8 shows an assembly with two monoliths and a manifold system connected to each other. The expanded view shows placement and details of the couplings described in FIGS. 5-7.

FIG. 9

Figure 9:
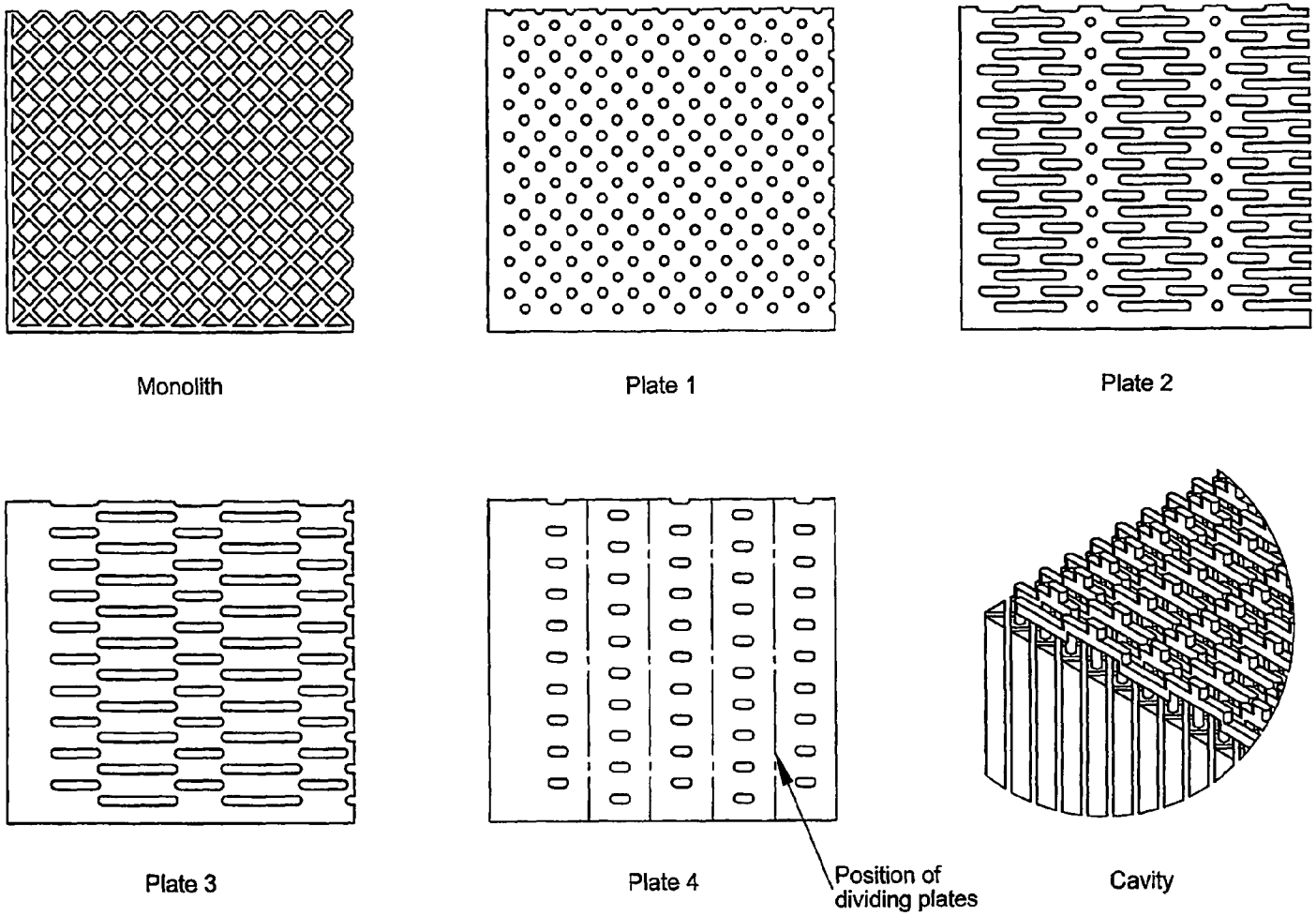
FIG. 9 illustrates an alternative converter design using a monolith with a cell pattern oriented at 45 degrees.

FIG. 9 shows an alternative converter design using a monolith with a cell pattern oriented in 45 degrees compared to the monolith wall. Such a monolith needs a maximum of four hole plates, compared to the solution in FIG. 3 that needs five hole plates. Also, the space or distance between dividing plates is increased compared to the method or system shown in FIG. 3, given the same monolith cell size. The lower right part of FIG. 9 shows the cavity. The cavity is what is left when all the material is taken away. The cavity of the "flow channels" inside the four hole plates can be seen.

FIG. 10

Figure 10:
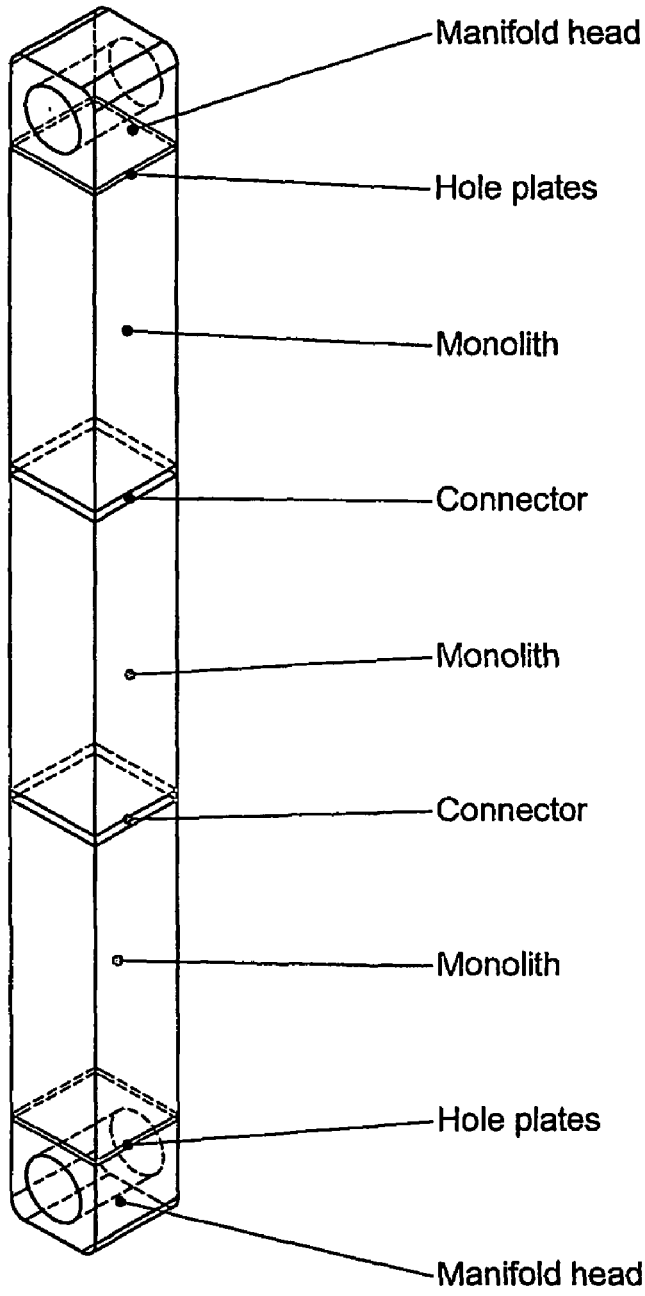
FIG. 10 illustrates an individual monolith stack.

FIG. 10 shows an individual monolith stack consisting of the monolith, the converter plates and manifold heads and shows connector plates. The connector plates are included only if the monolith stack is made up of two or more individual monoliths. This can be the case if the length of one individual monolith is not sufficient or because the system consists of monoliths with different functionalities or properties, for example, one monolith can be a heat exchanger and the other monolith can consist of a membrane structure. The connectors can consist of a graded material, such that, in a case of different thermal expansions of the monoliths, both connectors can be matched.

FIG. 11

Figure 11:
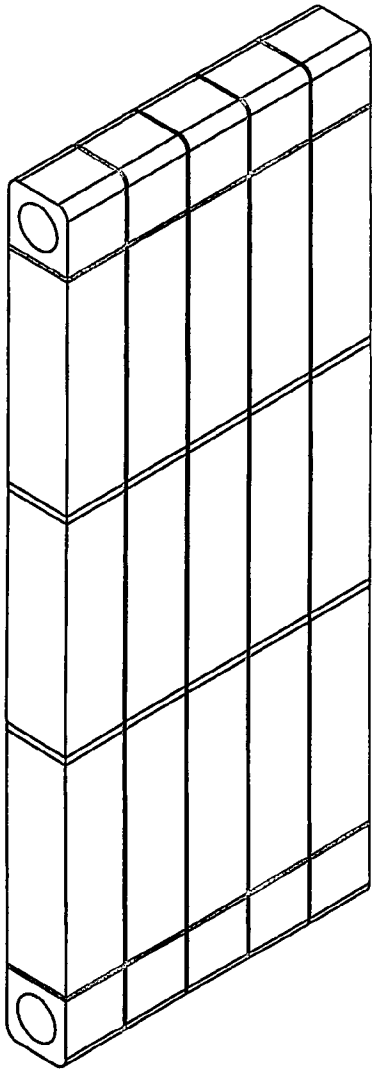
FIG. 11 illustrates a row of monolith stacks consisting of individual monolith stacks coupled together.

FIG. 11 shows a row of monolith stacks consisting of individual monolith stacks coupled together. To build up such a line of monolith stacks, the coupling system shown in FIG. 8 can be used. If scaling up to industrial sizes, one will start with the smallest repeating unit, which for this system would be the individual monolith stack as shown in FIG. 10. The next unit component is an assembly or a line of monolith stacks coupled together as shown in FIG. 11.

FIG. 12

Figure 12:
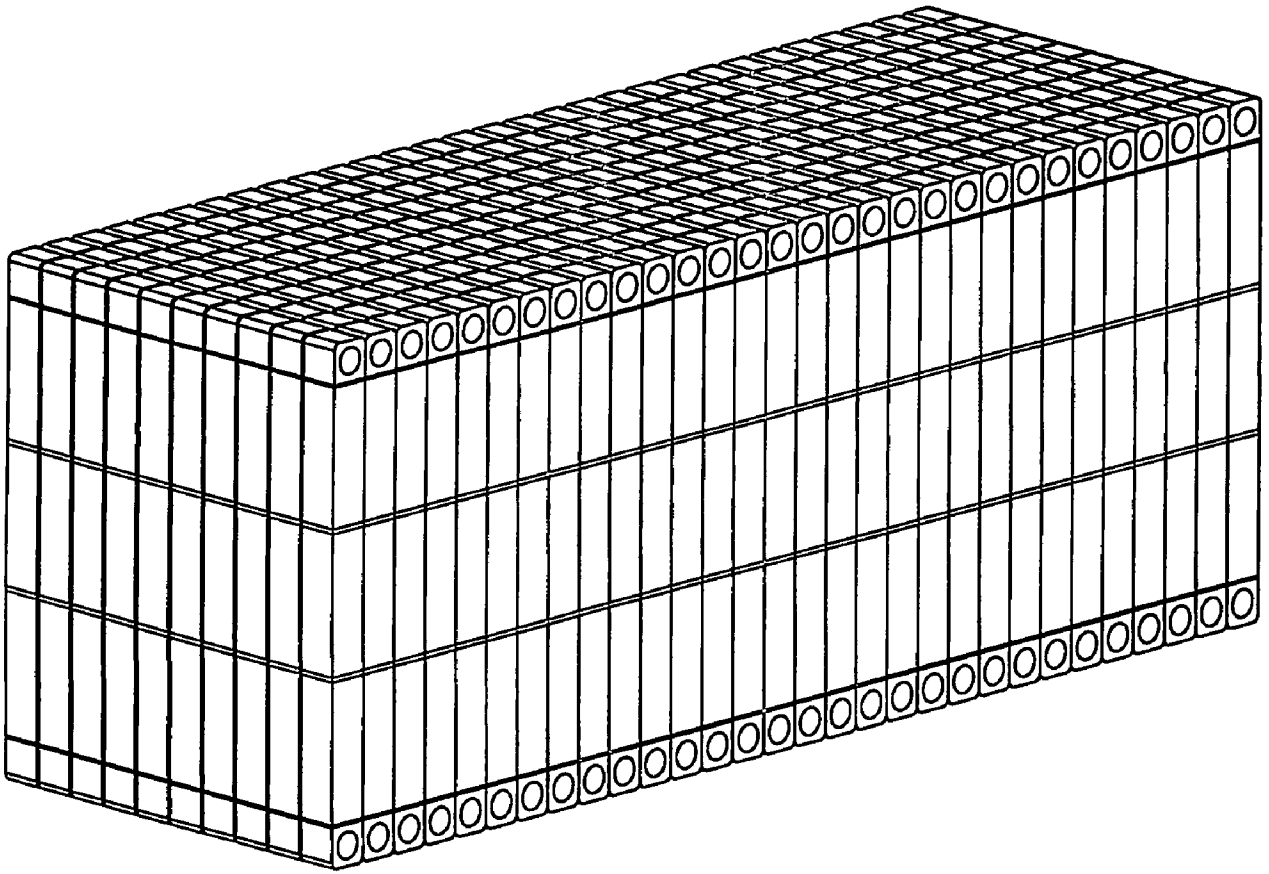
FIG. 12 illustrates a line of monolith stacks stacked wall-to-wall to form one large monolith block.

In large industrial scale applications, where many hundreds monoliths have to be used, it is of importance that the monolith stacks can be arranged close together for compact reactor design solutions. FIG. 12 shows a system or method where line of monolith stacks as shown in FIG. 11 are stacked wall to wall constituting one large "monolith block". In FIG. 12, one line or row consists of ten monolith stacks. The appropriate number of stacks per row depends on several factors. To fit into a cylindrical pressure vessel for maximum utilization of volume, the height of the stack and width of the monolith block should correspond. Thus, a stack height of 150 cm the row should consist of 10 monoliths if a width of the manifold head and the monolith is 15 cm. The capacity of the system can then be increased without increasing diameter of pressure vessel by simply increasing length and adding number of monolith stacks.

FIG. 13

Figure 13:
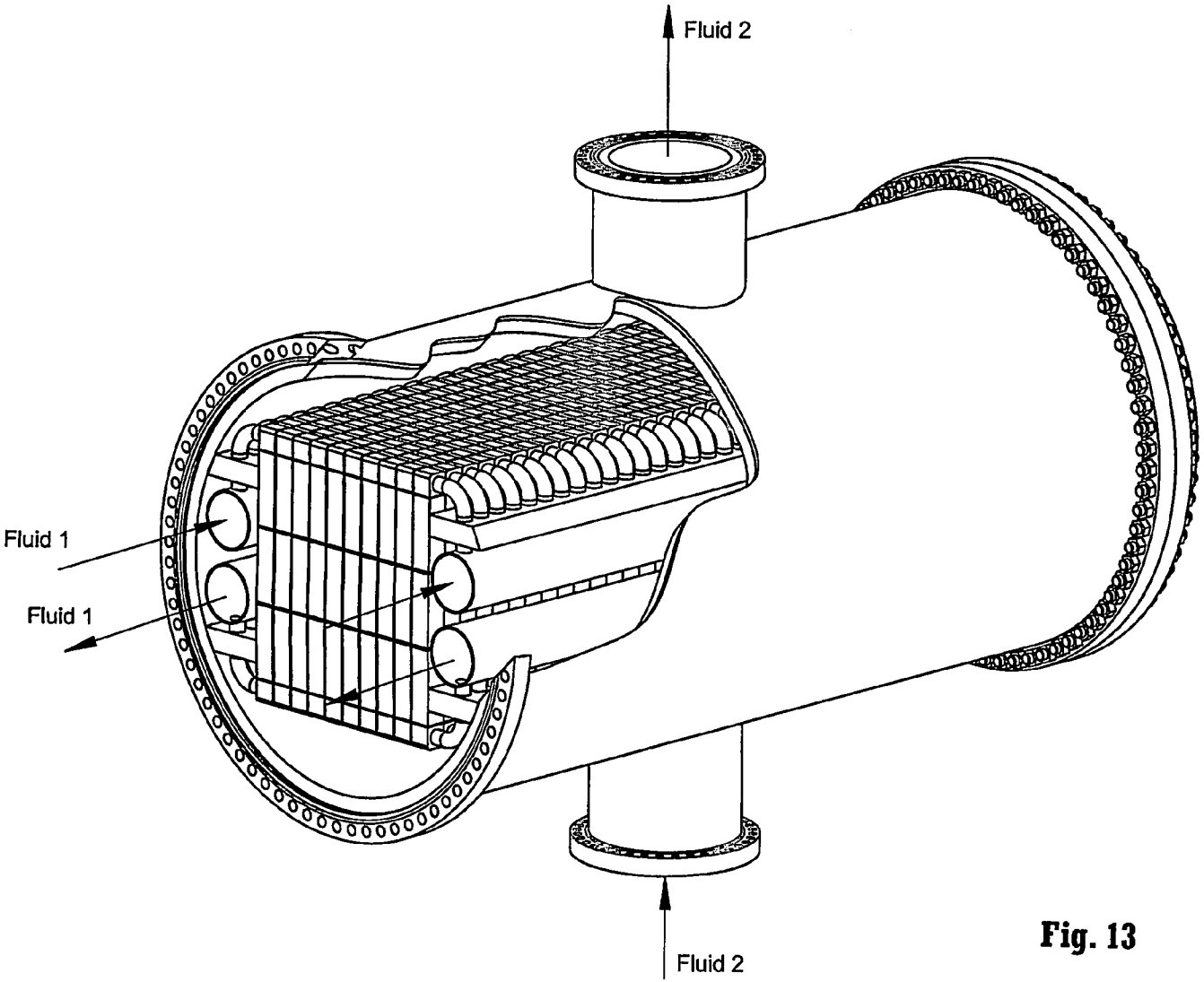
FIG. 13 illustrates an arrangement of a monolith block within a cylindrical pressure vessel.

FIG. 13 shows the arrangement of the monolith block within a cylindrical pressure vessel. As can be seen, the number of rows can be increased or decreased without changing the diameter of the pressure vessel. Thus, the system can simply be adjusted to a wide range of capacities by changing the number of rows and adjusting length of pressure vessel. In FIG. 13, fluid 1 is kept in a closed system by means of internal inlet and outlet collecting pipes. In FIG. 13, a counter-current flow system in the monoliths is shown were fluid 1 entering top manifold head in the monolith stacks flow downwards and is led out in the bottom manifold head. Fluid 2 enters the lower manifold head from ducts or open space inside the reactor vessel and flows upward in the monolith channels and out in the upper manifold head and into the top of the reactor were it is led out through the opening slots in the manifold heads in the upper part of the reactor.

FIG. 14

Figure 14:
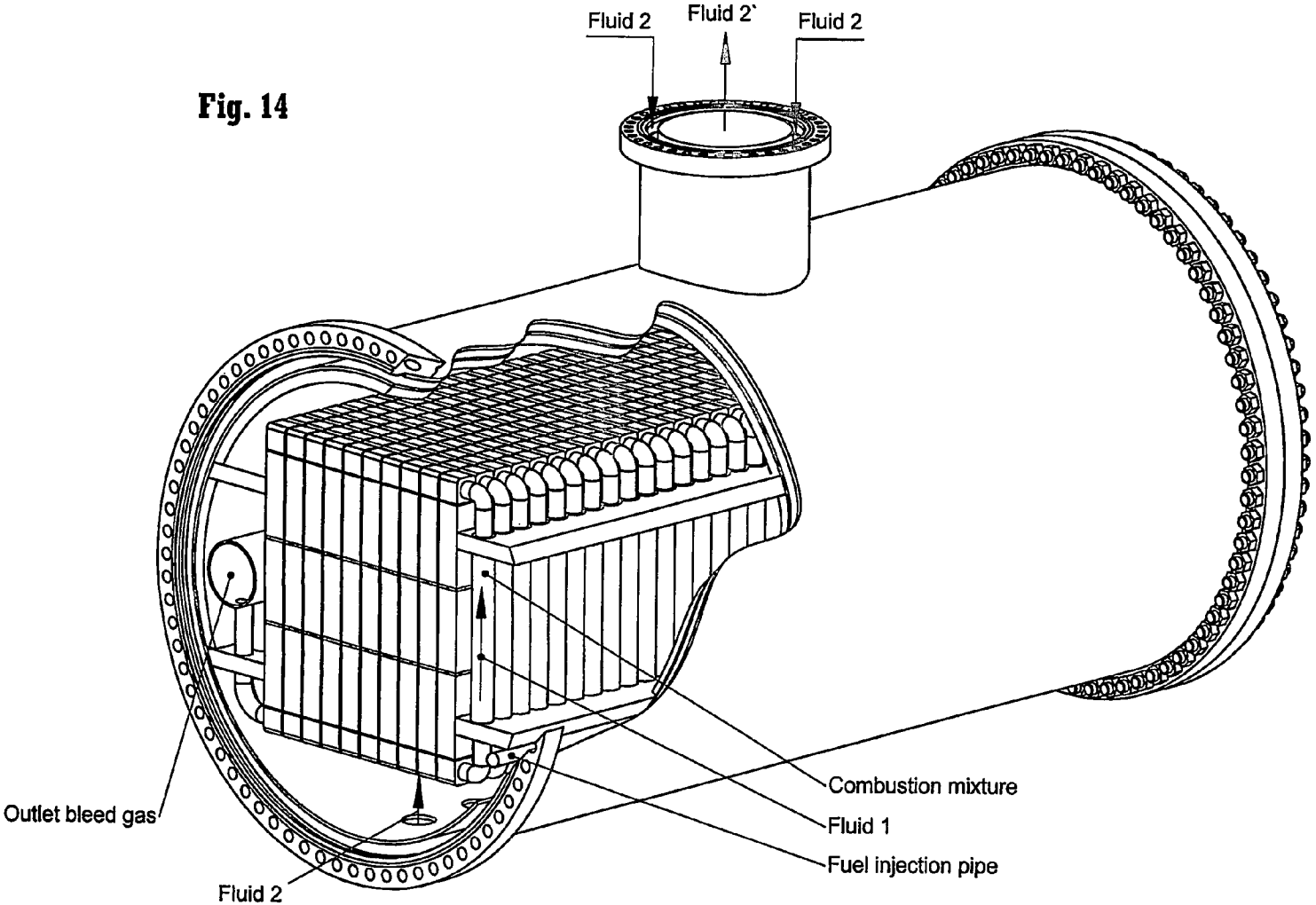
FIG. 14 illustrates a monolithic structure inside of a pressure or reactor vessel.

FIG. 14 shows the monolithic structures inside a pressure or reactor vessel. In this system, fluid 2 is fed in and out at the same position on the pressure vessel wall. This system could e.g., be adapted when fluid 2 comes from a compressor and fluid 2' is led out to a turbine. Fluid 2 could be air and fluid 2' could be oxygen depleted heated air. The monoliths can be ceramic oxygen delivering membranes and fluid 1 is the permeate fluid that receives the oxygen from air. Fuel could then be injected in fluid 1 and a combustion will take place consuming the oxygen and heat will be produced. With such a system the oxygen depleted fluid 1 (after combustion) could be returned to the monoliths with walls consisting of an oxygen transferring membrane. Fluid 1 is heated by combustion and heat is transferred from fluid 1 to the oxygen containing fluid 2. At a defined temperature level the membrane in the monolith wall transfer oxygen to fluid 1. The surplus mass due to injected fuel and oxygen can be led out as bleed gas through the monolith on the lefts side to a collector pipe. The monolith on the left side can then be used as a pure heat exchanger; heating air and cooling bleed gas. If fluid 1 consists of water vapor and carbon dioxide, such a design or system solution can be used for gas power production with $CO_2$ handling. A zero emission power plant can then be made if $CO_2$ is sent to permanent storage.

FIG. 15

Figure 15:
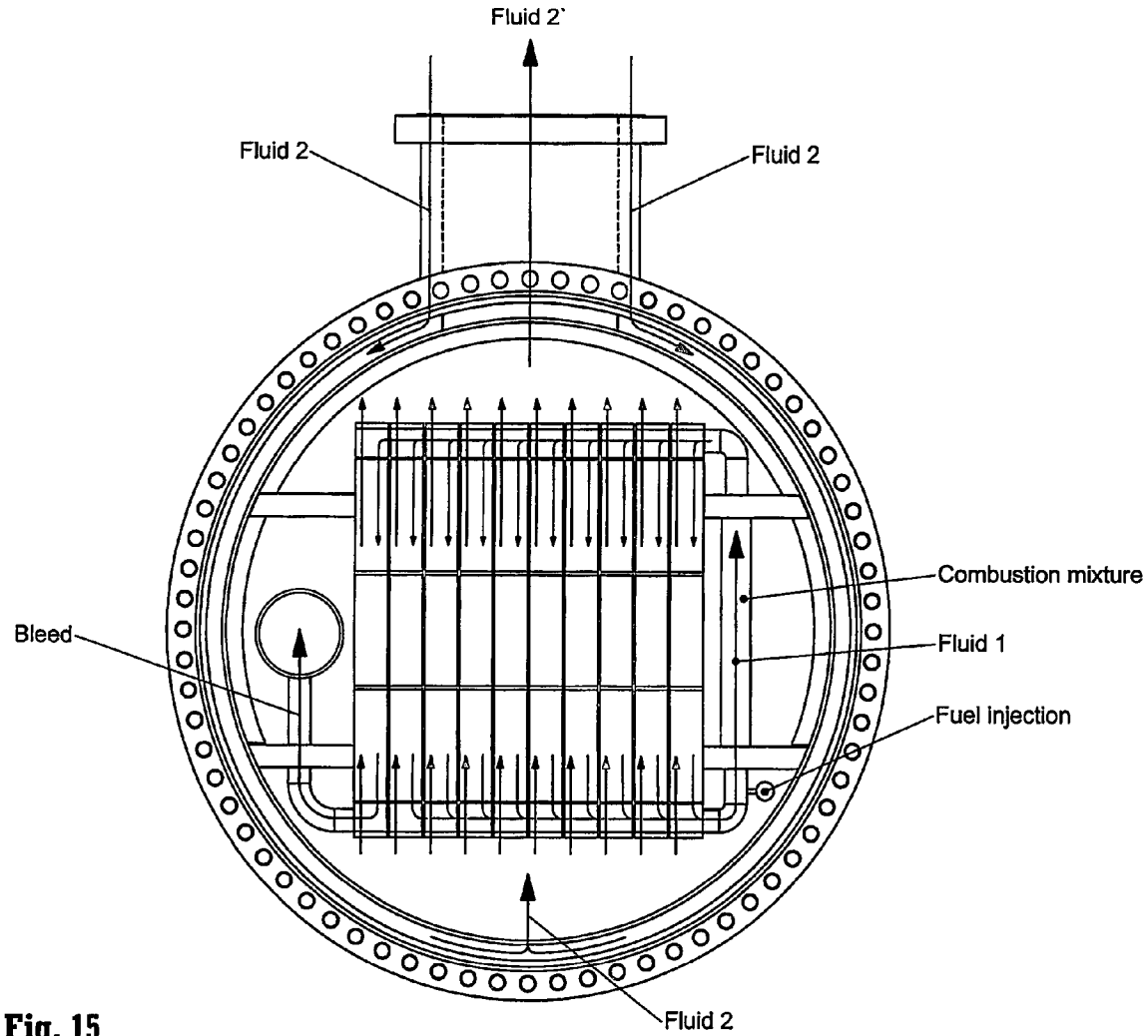
FIG. 15 illustrates a cross-sectional view of the reactor illustrated in FIG. 14.

FIG. 15 is a cross sectional view of the reactor shown in FIG. 14. This figure illustrates the process flow system by using arrows showing flow direction. It can be seen how inlet fluid 2 is led by ducts close to the inner wall and into the lower part of the reactor where it enters the lower manifold heads of the monolith stacks. Fluid 1 flows counter current to Fluid 2 in a circulation loop. For the system of zero emission gas power, fluid 2 is air and monoliths are ceramic oxygen membranes. Fluid 1 component can be water vapor and carbon dioxide, which then receives oxygen from air. A fuel like natural gas is then added for combustion and fluid 1 can then be returned to monoliths to receive oxygen (flux is driven by oxygen partial pressure difference) and heat Fluid 2 and 2' leaving for the power generating turbine. To ensure a mass balance in the fluid 1 circulation loop a bleed is taken out. Thus, the left monolith stack has a functionality of a pure heat exchanger. Fuel injection can be done by means of a fuel ejector to ensure circulation of fluid 1.

FIG. 16

Figure 16:
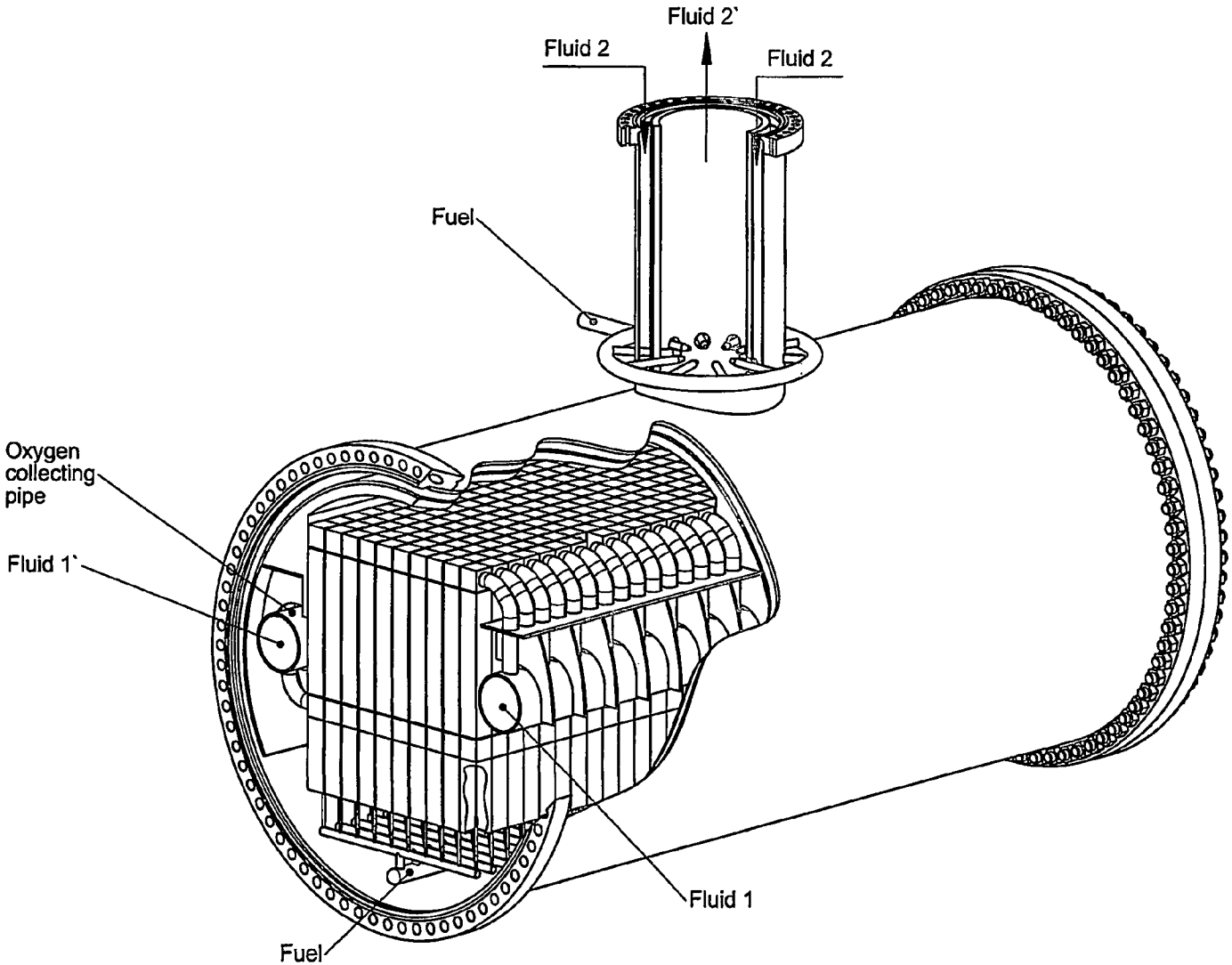
FIG. 16 illustrates a reactor for combined production of oxygen and power, where monoliths are mode of oxygen transporting membranes.

FIG. 16 shows a reactor concept for combined production of oxygen and power where the monoliths are made of oxygen transporting membranes. This illustrates the flexibility of the present invention for utilization of different process systems.

With only minor modification the same reactor concept as shown in FIGS. 14 and 15 can be used to combine oxygen and power production. Fluid 2 can be compressed air, which is heated in the bottom of reactor by means of gas burners. Thus, some of the oxygen in air is consumed to heat the air to a temperature suitable for the ceramic oxygen transporting membranes. Fluid 1 must have a lower partial pressure of oxygen than in fluid 2. The lower partial pressure ensures that oxygen is transported from fluid 2 to fluid 1 through the membrane. It is also possible to use vacuum to pull out the oxygen on the permeate side of the membrane instead of a fluid 1. This will directly produce pure oxygen that can be compressed to delivery or storage pressure.

For maximum power generating capacity, oxygen left in fluid 2 at the outlet of membranes can be used for increasing the temperature of air to turbine by having gas burners in outlet duct or pipe as shown on figure. Fluid 1 can in principle be any fluid (and even air at lower pressures than in fluid 2 ensuring oxygen positive partial pressure difference) capable of transporting oxygen out from the membrane and suitable for downstream separation from oxygen or direct applications.

FIG. 17

Figure 17:
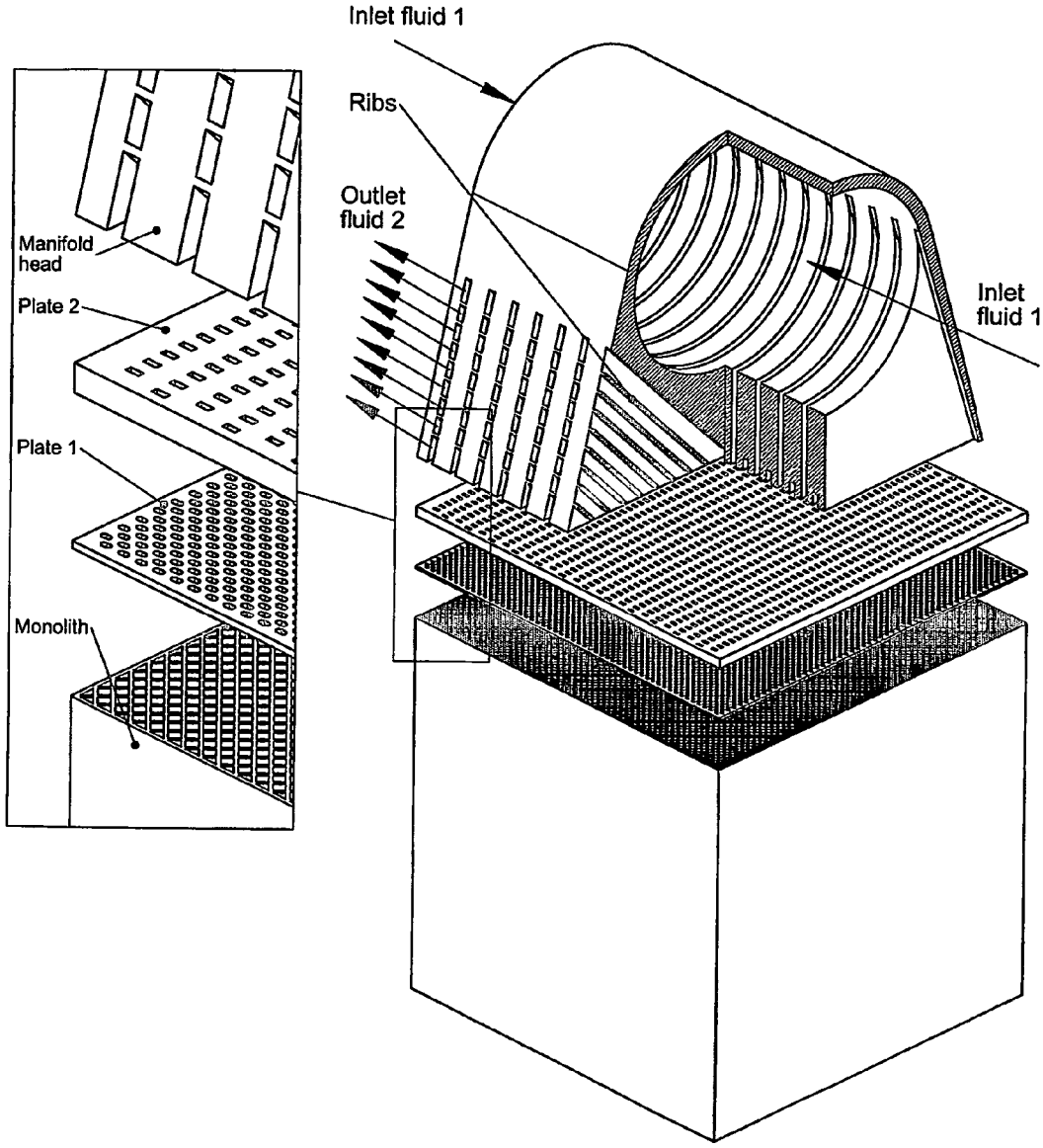
FIG. 17 illustrates a system assembly including a monolith, hole plates and a manifold head.

FIG. 17 shows the system assembly of monolith, hole plates and manifold head. In the illustrated manifold head, the outlet opening (here for fluid 2) has a shorter distance and a straighter direction than the manifold head in FIG. 2. The dividing plates have guiding ribs for fluid 2, which also provide mechanical support. The ribs are shaped to prevent blockage of the holes and minimize flow restriction for fluid 2. Fluid 1 has a circular inlet to the manifold head and open slots where fluid 1 can enter through the hole plates and into the monolith channels. There are no ribs or boss on the fluid 1 side of the dividing plate. In FIG. 9 a system of four individual plates for transferring the fluids are shown, compared to only 2 in FIG. 17. The plates illustrated in FIG. 17 hold the same functionality as the four plates of FIG. 9. Plate 1 corresponds to plate 1 of FIG. 9 and plate 2 corresponds to plates 2-4 of FIG. 9.

FIG. 18

Figure 18:
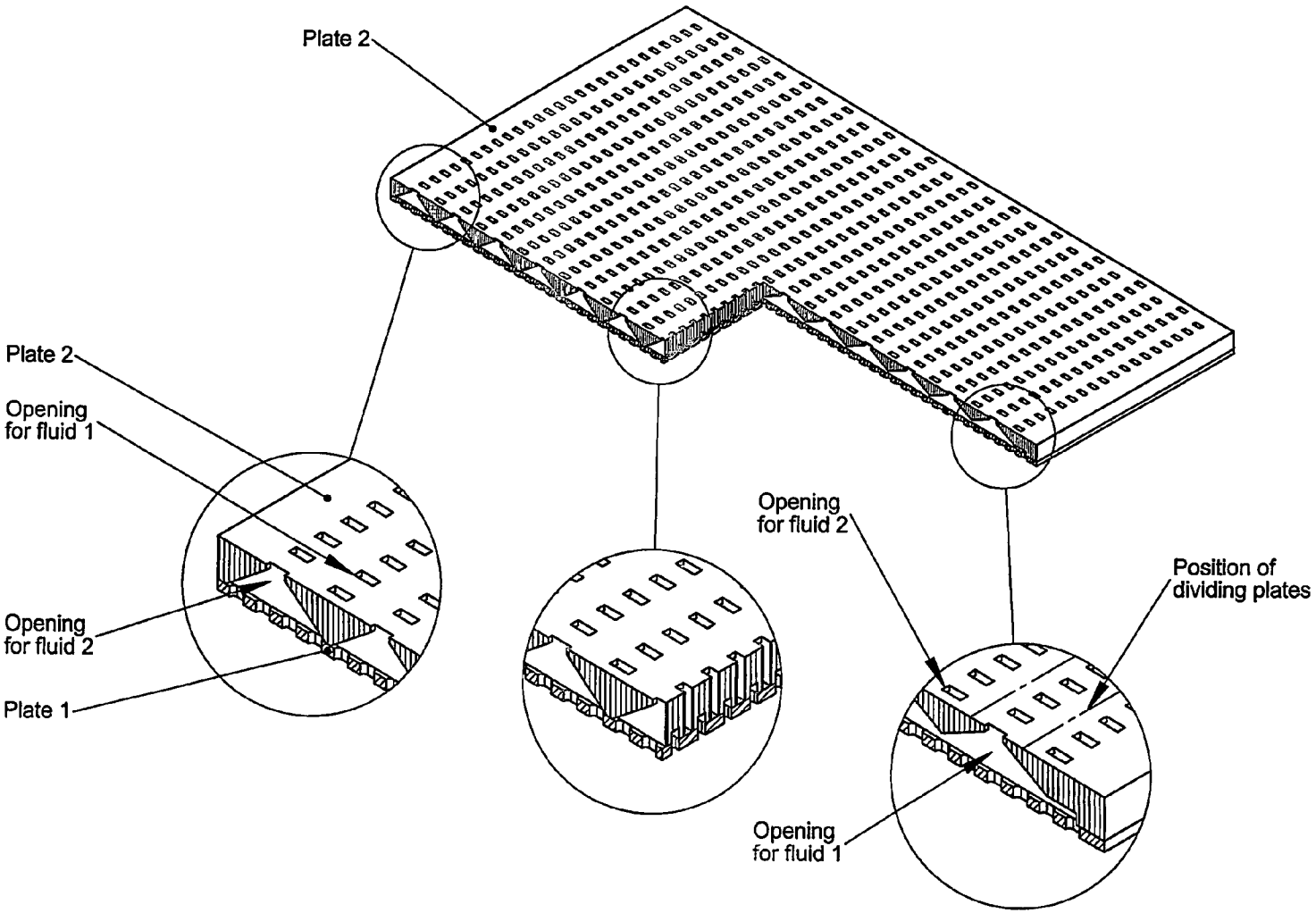
FIG. 18 illustrates detailed views inside of plate 2 and plate 1.

FIG. 18 shows detail views inside plate 2 and plate 1. The thickness of plate 2 is dependant on the sloping angle of the funnel leading to the opening holes in plate 1 for fluid 1 and fluid 2 as well as the number of holes from plate 1 each funnel shall collect. As can bee seen from the exploded view on the left hand side the funnel for fluid 2 collects from four holes from plate 1 and thus also from four channels from the monolith. The exploded view on the right hand side shows the funnel for fluid 1 and, as can bee seen, these funnels collect or distribute to five holes in plate 1. Due to symmetry, an even number of holes is made for each funnel. Every fifth hole has then to be distributed to two funnels. FIG. 18 illustrates only a principle design of plate 2. Thus, all kinds of combinations, between the number of holes that each funnel collects from or distributes to, can be chosen freely. The selected combination will depend on a set of parameters among them pressure drop, the number and distance between dividing plates.

The present invention offers possibilities for improvement and simplification of unit operations for heat and mass transfer (separation) by utilizing the monolithic structures' compactness (i.e. large surface area per volume unit with small channels), low flow resistance for gases and high-temperature resistant ceramic material, which can be coated with a catalyst. The improvements will be associated with use of the monoliths in mass and heat transfer between two different fluids and the fact that these unit operations in the monolithic structure can be integrated with a chemical reaction. Such a combination of mass and heat transfer and chemical reaction (unit operations) in the monoliths will contribute to producing compact solutions in which transport and separation are simplified. One application will be a combination of endothermic and exothermic reactions, for example steam methane reformation of natural gas or other substances containing hydrocarbons to syntheses gas (hydrogen and carbon monoxide) with endothermic steam methane reformation in catalyst-coated channels and exothermic combustion in adjacent channels. Such monolithic structures can produce very compact reformers and can, for example, be used for small-scale hydrogen production. However, syntheses gas can also be processed further into a number of other products, for example methanol, ammonia and synthetic petrol/diesel.

Higher operating temperatures where metals not can be used (800-900° C. and above) are favorable in terms of equilibrium or thermodynamics by many chemical processes. In such processes, ceramic monoliths, which can both be coated with catalyst and tolerate higher temperatures, can be very advantageous. Thus a combustion or hot gas process can directly be combined with a chemical reaction process.

Monolithic structures can also be used in the energy market (power production), for example for catalytic combustion of natural gas. By utilizing the present invention the temperature window of the combustion process can be controlled resulting in reduced nitrogen oxide (NOx) production. Combustion or oxidation in air or any atmosphere were oxygen and nitrogen is present always will have the potential of producing NOx. This environmentally harmful gas is mainly produced in the high temperature zones of the combustion flame. By utilizing the present invention with chessboard flow gas distribution in the monolith, one can have catalytic combustion of a mixture of fuel and air producing heat in the "black" channels and a passive coolant (i.e. air) in the "white" channels or an active coolant performing an endothermic reaction (i.e. steam methane reforming) in the "white" channels. Such a system will prevent peek temperatures and thus reduce NOx production. Furthermore, with this system one can mix coolant and combustion gas downstream to the monolith by having a manifold only in inlet position (given co current flow) and thus a very efficient mixing in outlet position due to chessboard pattern and small channels in the monolith.

The system described above for preventing NOx formation can also be used for preventing/reducing emission of other unwanted components. Thus, the present invention can combine combustion (heat production) and heat transfer directly in monolith structures through the thin contact wall between two fluids.

The invention claimed is:

1. A manifold system for separate distribution of first and second fluids, the manifold system comprising:

a multi-channel monolithic structure; and a manifold head connected to said multi-channel monolithic structure by at least one hole plate located between said manifold head and said multi-channel monolithic structure, wherein said multi-channel monolithic structure includes outer structure walls and inner channel walls defining channel openings of a plurality of channels of said multi-channel monolithic structure, said channel openings of said plurality of channels being spread over an entire cross-sectional area of said multi-channel monolithic structure, and said plurality of channels sharing at least a portion of said inner channel walls, wherein said manifold head includes a plurality of plenum gaps including first plenum gaps and second plenum gaps, said first plenum gaps being for receiving the first fluid and said second plenum gaps being for receiving the second fluid, wherein said manifold head includes a plurality of dividing plates connected in series, each dividing plate of said plurality of dividing plates having a plenum gap of said plurality of plenum gaps located therebetween, said first plenum gaps and said second plenum gaps being located between said dividing plates of said plurality of dividing plates and being arranged in an alternating manner, such that, for each respective dividing plate of said plurality of dividing plates, a respective first plenum gap of said first plenum gaps is located on one side of said dividing plate and a respective second plenum gap of said second plenum gaps is located on another side of said dividing plate, wherein said manifold head includes a first tunnel and a second entry/exit point distributing the first and second fluids separately into and out of said plurality of plenum gaps and into and out of said plurality of channels to effect mass and/or heat transfer between the first and second fluids, wherein said first tunnel of said manifold head includes a first tunnel wall having through slots formed in said plurality of dividing plates for communicating with one or more of said first plenum gaps of said manifold head, wherein said second entry/exit point of said manifold head includes a second wall having through slots formed in said plurality of dividing plates for communicating with one or more of said second plenum gaps of said manifold head, wherein each of the first and second fluids is fed separately through said manifold head, such that (i) the first fluid is fed through said first tunnel and said through slots communicating with said one or more first plenum gaps to distribute the first fluid into specific channels of said plurality of channels of said multi-channel monolithic structure, (ii) the second fluid is fed through said second entry/exit point and said through slots communicating with said one or more second plenum gaps to distribute the second fluid into specific channels of said plurality of channels of said multi-channel monolithic structure, and (iii) at least one of said inner channel walls is common between the first fluid and the second fluid as the first fluid and the second fluid are respectively fed through said first tunnel and said second entry/exit point, and wherein said manifold head distributes the first fluid and the second fluid into the specific channels of said multi-channel monolithic structure in a chessboard configuration via one hole plate, of said at least one hole plate, having a plurality of holes provided between said multi-channel monolithic structure and said plurality of dividing plates of said manifold head, said one hole plate being configured to distribute the first and second fluids out of or into rows of plenum gaps of said plurality of plenum gaps out of or into the chessboard configuration of channels of said multi-channel monolithic structure, such that, when one of the first fluid and the second fluid is distributed into a first channel of the specific channels, another one of the first fluid and the second fluid is distributed into all channels, of the specific channels, which are adjacent to the first channel of the specific channels.

2. The manifold system according to claim 1, wherein three dividing plates of said plurality of dividing plates are joined together by spacers, such that said spacers form said plurality of plenum gaps, wherein said manifold head includes end cover plates joined in parallel to said three dividing plates, wherein each of said three dividing plates and each of said end cover plates includes an inner opening, such that the inner openings of said three dividing plates and said end cover plates form said first tunnel of said manifold head extending through said three dividing plates, and wherein said first tunnel wall includes slots communicating with one or more of said first plenum gaps of said manifold head, such that the first fluid enters said one or more first plenum gaps.

3. The manifold system according to claim 2, wherein said three dividing plates are sealed to said at least one hole plate having a plurality of holes.

4. The manifold system according to claim 2, wherein said three dividing plates are sealed directly to said inner channel walls of said multi-channel monolithic structure.

5. The manifold system according to claim 1, wherein said manifold head is sealed to at least one face of said multi-channel monolithic structure where said channel openings are located, and wherein said at least one hole plate having a plurality of holes is sealed between said manifold head and said at least one face of said multi-channel monolithic structure.

6. The manifold system according to claim 5, wherein said holes of said at least one hole plate are positioned such that the first and second fluids flow from said plurality of channels of said multi-channel monolithic structure to said first plenum gaps and said second plenum gaps of said manifold head and vice versa.

7. The manifold system according to claim 5, wherein said at least one hole plate or a system of said hole plates provides a hole pattern equivalent to a pattern provided by said plurality of channels of said multi-channel monolithic structure.

8. The manifold system according to claim 1, wherein one or more of said inner channel walls are coated with one or more catalytic active components.

9. The manifold system according to claim 1, wherein said channel openings of said plurality of channels are evenly distributed over the entire cross-sectional area of said multi-channel monolithic structure in the chessboard configuration.

10. The manifold system according to claim 1, wherein said inner channel walls of said multi-channel monolithic structure are oriented at a 45 degree angle with respect to said outer structure walls.

11. The manifold system according to claim 1, wherein said manifold head is sealed to at least one face of said multi-channel monolithic structure where the said channel openings are located.

12. A manifold stack comprising:

a first multi-channel monolithic structure;

a second multi-channel monolithic structure; and a manifold head connected to said first multi-channel monolithic structure by at least one hole plate located between said manifold head and said first multi-channel monolithic structure, wherein said manifold head includes a plurality of plenum gaps including first plenum gaps and second plenum gaps, said first plenum gaps being for receiving the first fluid and said second plenum gaps being for receiving the second fluid, wherein said manifold head includes a plurality of dividing plates connected in series, each dividing plate of said plurality of dividing plates having a plenum gap of said plurality of plenum gaps located therebetween, said first plenum gaps and said second plenum gaps being located between said dividing plates of said plurality of dividing plates and being arranged in an alternating manner, such that, for each respective dividing plate of said plurality of dividing plates, a respective first plenum gap of said first plenum gaps is located on one side of said dividing plate and a respective second plenum gap of said second plenum gaps is located on another side of said dividing plate, wherein said manifold head includes a first tunnel and a second entry/exit point distributing the first and second fluids separately into and out of said plurality of plenum gaps and into and out of a plurality of channels of said first multi-channel monolithic structure to effect mass and/or heat transfer between the first and second fluids, wherein said first multi-channel monolithic structure includes outer structure walls and inner channel walls defining channel openings of said plurality of channels of said first multi-channel monolithic structure, said channel openings of said plurality of channels being spread over an entire cross-sectional area of said first multi-channel monolithic structure, and said plurality of channels sharing at least a portion of said inner channel walls, wherein said second multi-channel monolithic structure includes outer structure walls and inner channel walls defining channel openings of a plurality of channels of said second multi-channel monolithic structure, said channel openings of said plurality of channels of said second multi-channel monolithic structure being spread over an entire cross-sectional area of said second multi-channel monolithic structure, and said plurality of channels of said second multi-channel monolithic structure sharing at least a portion of said inner channel walls of said second multi-channel monolithic structure, wherein said first tunnel of said manifold head includes a first tunnel wall having through slots formed in said plurality of dividing plates for communicating with one or more of said first gaps of said manifold head, wherein said second entry/exit point of said manifold head includes a second wall having through slots formed in said plurality of dividing plates for communicating with one or more of said second plenum gaps of said manifold head, wherein said manifold head is sealed to at least one face of said first multi-channel monolithic structure, where said channel openings are located, wherein said at least one hole plate is sealed between said manifold head and said at least one face of said first multi-channel monolithic structure, wherein each of the first and second fluids is fed separately through said manifold head, such that (i) the first fluid is fed through said first tunnel and said through slots communicating with said one or more first plenum gaps to distribute the first fluid into specific channels of said plurality of channels of said first multi-channel monolithic structure, (ii) the second fluid is fed through said second entry/exit point and said through slots communicating with said one or more second plenum gaps to distribute the second fluid into specific channels of said plurality of channels of said first multi-channel monolithic structure, and (iii) at least one of said inner channel walls of said first multi-channel monolithic structure is common between the first fluid and the second fluid as the first fluid and the second fluid are respectively fed through said first tunnel and said second entry/exit point, wherein said manifold head distributes the first fluid and the second fluid into the specific channels of said first multi-channel monolithic structure in a chessboard configuration via one hole plate, of said at least one hole plate, having a plurality of holes provided between said first multi-channel monolithic structure and said plurality of dividing plates of said manifold head, said one hole plate being configured to distribute the first and second fluids out of or into rows of plenum gaps of said plurality of plenum gaps out of or into the chessboard configuration of channels of said first multi-channel monolithic structure, such that, when one of the first fluid and the second fluid is distributed into a first channel of the specific channels of said first multi-channel monolithic structure, another one of the first fluid and the second fluid is distributed into all channels, of the specific channels of said first multi-channel monolithic structure, which are adjacent to the first channel of the specific channels of said first multi-channel monolithic structure, and wherein said manifold stack includes at least one connector plate or another coupling device connecting said manifold head and/or said first multi-channel monolithic structure to a neighboring manifold head or said second multi-channel monolithic structure.

13. A row of manifold systems, said row comprising:

a first manifold system; and a second manifold system, wherein each of said first manifold system and said second manifold system respectively includes:

a multi-channel monolithic structure; and a manifold head connected to said multi-channel monolithic structure by at least one hole plate located between said manifold head and said multi-channel monolithic structure, wherein said respective multi-channel monolithic structure, of each respective manifold system of said first and second manifold systems, includes outer structure walls and inner channel walls defining channel openings of a plurality of channels of said multi-channel monolithic structure, said channel openings of said plurality of channels being spread over an entire cross-sectional area of said multi-channel monolithic structure, and said plurality of channels sharing at least a portion of said inner channel walls, wherein said respective manifold head, of each respective manifold system of said first and second manifold systems, includes a plurality of plenum gaps including first plenum gaps and second plenum gaps, said first plenum gaps being for receiving the first fluid and said second plenum gaps being for receiving the second fluid, wherein said respective manifold head includes a plurality of dividing plates connected in series, each dividing plate of said plurality of dividing plates having a plenum gap of said plurality of plenum gaps located therebetween, said first plenum gaps and said second plenum gaps being located between said dividing plates of said plurality of dividing plates and being arranged in an alternating manner, such that, for each respective dividing plate of said plurality of dividing plates, a respective first plenum gap of said first plenum gaps is located on one side of said dividing plate and a respective second plenum gap of said second plenum gaps is located on another side of said dividing plate, wherein said respective manifold head includes a first tunnel and a second entry/exit point distributing the first and second fluids separately into and out of said plurality of plenum gaps and into and out of said plurality of channels to effect mass and/or heat transfer between the first and second fluids, wherein said first tunnel of said respective manifold head includes a first tunnel wall having through slots formed in said plurality of dividing plates for communicating with one or more of said first plenum gaps of said respective manifold head, wherein said second entry/exit point of said respective manifold head includes a second wall having through slots formed in said plurality of dividing plates for communicating with one or more of said second plenum gaps of said respective manifold head, wherein each fluid of the first and second fluids is fed separately through said respective manifold head, such that (i) the first fluid is fed through said first tunnel and said through slots communicating with said one or more first plenum gaps to distribute the first fluid into specific channels of said plurality of channels of said respective multi-channel monolithic structure, (ii) the second fluid is fed through said second entry/exit point and said through slots communicating with said one or more second plenum gaps to distribute the second fluid into specific channels of said plurality of channels of said respective multi-channel monolithic structure, and (iii) at least one of said inner channel walls is common between the first fluid and the second fluid as the first fluid and the second fluid are respectively fed through said first tunnel and said second entry/exit point of said respective manifold head, wherein said respective manifold head distributes the first fluid and the second fluid into the specific channels of said respective multi-channel monolithic structure in a chessboard configuration via one hole plate, of said at least one hole plate, having a plurality of holes provided between said respective multi-channel monolithic structure and said plurality of dividing plates of said respective manifold head, said one hole plate being configured to distribute the first and second fluids out of or into rows of plenum gaps of said plurality of plenum gaps out of or into the chessboard configuration of channels of said respective multi-channel monolithic structure, such that, when one of the first fluid and the second fluid is distributed into a first channel of the specific channels, another one of the first fluid and the second fluid is distributed into all channels, of the specific channels, which are adjacent to the first channel of the specific channels, and wherein a sealing ring and two different types (type A and B) of end covers of said manifold head of said first manifold system connect said manifold head of said first manifold system with said manifold head of said second manifold system.

14. A block comprising:

a first row; and a second row, wherein said first row and said second row are stapled face to face, wherein each respective row, of said first row and said second row includes:

a first manifold system; and a second manifold system, wherein each of said first manifold system and said second manifold system respectively includes:

a multi-channel monolithic structure; and a manifold head connected to said multi-channel monolithic structure by at least one hole plate located between said manifold head and said multi-channel monolithic structure, wherein said multi-channel monolithic structure, of each respective manifold system of said first and second manifold systems, includes outer structure walls and inner channel walls defining channel openings of a plurality of channels of said multi-channel monolithic structure, said channel openings of said plurality of channels being spread over an entire cross-sectional area of said multi-channel monolithic structure, and said plurality of channels sharing at least a portion of said inner channel walls, wherein said respective manifold head, of each respective manifold system of said first and second manifold systems, includes a plurality of plenum gaps including first plenum gaps and second plenum gaps, said first plenum gaps being for receiving the first fluid and said second plenum gaps being for receiving the second fluid, wherein said respective manifold head includes a plurality of dividing plates connected in series, each dividing plate of said plurality of dividing plates having a plenum gap of said plurality of plenum gaps located therebetween, said first plenum gaps and said second plenum gaps being located between said dividing plates of said plurality of dividing plates and being arranged in an alternating manner, such that, for each respective dividing plate of said plurality of dividing plates, a respective first plenum gap of said first plenum gaps is located on one side of said dividing plate and a respective second plenum gap of said second plenum gaps is located on another side of said dividing plate, wherein said respective manifold head includes a first tunnel and a second entry/exit point distributing the first and second fluids separately into and out of said plurality of plenum gaps and into and out of said plurality of channels to effect mass and/or heat transfer between the first and second fluids, wherein said first tunnel of said respective manifold head includes a first tunnel wall having through slots formed in said plurality of dividing plates communicating with one or more of said first plenum gaps of said respective manifold head, wherein said second entry/exit point of said respective manifold head includes a second wall having through slots formed in said plurality of dividing plates communicating with one or more of said second plenum gaps of said respective manifold head, wherein each of the first and second fluids is fed separately through said respective manifold head such that (i) the first fluid is fed through said first tunnel and said through slots communicating with said one or more first plenum gaps to distribute the first fluid into specific channels of said plurality of channels of said respective multi-channel monolithic structure, (ii) the second fluid is fed through said second entry/exit point and said through slots communicating with said one or more second plenum gaps to distribute the second fluid into specific channels of said plurality of channels of said respective multi-channel monolithic structure, and (iii) at least one of said inner channel walls is common between the first fluid and the second fluid as the first fluid and the second fluid are respectively fed through said first tunnel and said second entry/exit point of said respective manifold head, wherein said respective manifold head distributes the first fluid and the second fluid into the specific channels of said respective multi-channel monolithic structure in a chessboard configuration via one hole plate, of said at least one hole plate, having a plurality of holes provided between said respective multi-channel monolithic structure and said plurality of dividing plates of said respective manifold head, said one hole plate being configured to distribute the first and second fluids out of or into rows of plenum gaps of said plurality of plenum gaps out of or into the chessboard configuration of channels of said respective multi-channel monolithic structure, such that, when one of the first fluid and the second fluid is distributed into a first channel of the specific channels, another one of the first fluid and the second fluid is distributed into all channels, of the specific channels, which are adjacent to the first channel of the specific channels, and wherein a sealing ring and two different types (type A and B) of end covers of said manifold head of said first manifold system connect said manifold head of said first manifold system with said manifold head of said second manifold system.

15. A reactor for mass and/or heat transfer between first and second fluids, said reactor comprising:

a manifold system for separate distribution of the first and second fluids, said manifold system including:

a multi-channel monolithic structure; and a manifold head connected to said multi-channel monolithic structure by at least one hole plate located between said manifold head and said multi-channel monolithic structure, wherein said multi-channel monolithic structure includes outer structure walls and inner channel walls defining channel openings of a plurality of channels of said multi-channel monolithic structure, said channel openings of said plurality of channels being spread over an entire cross-sectional area of said multi-channel monolithic structure, and said plurality of channels sharing at least a portion of said inner channel walls, wherein said manifold head includes a plurality of plenum gaps including first plenum gaps and second plenum gaps, said first plenum gaps being for receiving the first fluid and said second plenum gaps being for receiving the second fluid, wherein said manifold head includes a plurality of dividing plates connected in series, each dividing plate of said plurality of dividing plates having a plenum gap of said plurality of plenum gaps located therebetween, said first plenum gaps and said second plenum gaps being located between said dividing plates of said plurality of dividing plates and being arranged in an alternating manner, such that, for each respective dividing plate of said plurality of dividing plates, a respective first plenum gap of said first plenum gaps is located on one side of said dividing plate and a respective second plenum gap of said second plenum gaps is located on another side of said dividing plate, wherein said manifold head includes a first tunnel and a second entry/exit point distributing the first and second fluids separately into and out of said plurality of plenum gaps and into and out of said plurality of channels to effect mass and/or heat transfer between the first and second fluids, wherein said first tunnel of said manifold head includes a first tunnel wall having through slots formed in said plurality of dividing plates communicating with one or more of said first gaps of said manifold head, wherein said second entry/exit point of said manifold head includes a second wall having through slots formed in said plurality of dividing plates communicating with one or more of said second plenum gaps of said manifold head, wherein each of the first and second fluids is fed separately through said manifold head, such that (i) the first fluid is fed through said first tunnel and said through slots communicating with said one or more first plenum gaps to distribute the first fluid into specific channels of said plurality of channels of said multi-channel monolithic structure, (ii) the second fluid is fed through said second entry/exit point and said through slots communicating with said one or more second plenum gaps to distribute the second fluid into specific channels of said plurality of channels of said multi-channel monolithic structure, and (iii) at least one of said inner channel walls is common between the first fluid and the second fluid as the first fluid and the second fluid are respectively fed through said first tunnel and said second entry/exit point, and wherein said manifold head distributes the first fluid and the second fluid into the specific channels of said multi-channel monolithic structure in a chessboard configuration via one hole plate, of said at least one hole plate, having a plurality of holes provided between said multi-channel monolithic structure and said plurality of dividing plates of said manifold head, said one hole plate being configured to distribute the first and second fluids out of or into rows of plenum gaps of said plurality of plenum gaps out of or into the chessboard configuration of channels of said multi-channel monolithic structure, such that, when one of the first fluid and the second fluid is distributed into a first channel of the specific channels, another one of the first fluid and the second fluid is distributed into all channels, of the specific channels, which are adjacent to the first channel of the specific channels.

16. A method for mass and/or heat transfer between first and second fluids of a manifold system including (i) a multi-channel monolithic structure and (ii) a manifold head connected to the multi-channel monolithic structure by at least one hole plate located between the manifold head and the multi-channel monolithic structure, wherein the multi-channel monolithic structure includes outer structure walls and inner channel walls defining channel openings of a plurality of channels of the multi-channel monolithic structure, the channel openings of the plurality of channels being spread over an entire cross-sectional area of the multi-channel monolithic structure, and the plurality of channels sharing at least a portion of the inner channel walls, wherein the manifold head includes a plurality of plenum gaps including first plenum gaps and second plenum gaps, the first plenum gaps being for receiving the first fluid and the second plenum gaps being for receiving the second fluid, wherein the manifold head includes a plurality of dividing plates connected in series, each dividing plate of the plurality of dividing plates having a plenum gap of the plurality of plenum gaps located therebetween, the first plenum gaps and the second plenum gaps being located between the dividing plates of the plurality of dividing plates and being arranged in an alternating manner, such that, for each respective dividing plate of the plurality of dividing plates, a respective first plenum gap of the first plenum gaps is located on one side of the dividing plate and a respective second plenum gap of the second plenum gaps is located on another side of the dividing plate, wherein the manifold head includes a first tunnel and a second entry/exit point distributing the first and second fluids separately into and out of the plurality of plenum gaps and into and out of the plurality of channels to effect mass and/or heat transfer between the first and second fluids, wherein the first tunnel of the manifold head includes a first tunnel wall having through slots formed in the plurality of dividing plates communicating with one or more of the first plenum gaps of the manifold head, wherein the second entry/exit point of the manifold head includes a second wall having through slots formed in the plurality of dividing plates communicating with one or more of the second plenum gaps of the manifold head, wherein each of the first and second fluids is fed separately through the manifold head, such that (i) the first fluid is fed through the first tunnel and the through slots communicating with the one or more first plenum gaps to distribute the first fluid into specific channels of the plurality of channels of the multi-channel monolithic structure, (ii) the second fluid is fed through the second entry/exit point and the through slots communicating with the one or more second plenum gaps to distribute the second fluid into specific channels of the plurality of channels of the multi-channel monolithic structure, and (iii) at least one of the inner channel walls is common between the first fluid and the second fluid as the first fluid and the second fluid are respectively fed through the first tunnel and the second entry/exit point, and wherein the manifold head distributes the first fluid and the second fluid into the specific channels of the multi-channel monolithic structure in a chessboard manner via one hole plate, of the at least one hole plate, having a plurality of holes provided between the multi-channel monolithic structure and the plurality of dividing plates of the manifold head, the one hole plate being configured to distribute the first and second fluids out of or into rows of plenum gaps of the plurality of plenum gaps out of or into the chessboard configuration of channels of the multi-channel monolithic structure, such that, when one of the first fluid and the second fluid is distributed into a first channel of the specific channels, another one of the first fluid and the second fluid is distributed into all channels, of the specific channels, which are adjacent to the first channel of the specific channels, and wherein said method comprises:

distributing the first and second fluids through the manifold system.

17. A row of stacks comprising:

a first manifold stack; and a second manifold stack, wherein said first manifold stack and said second manifold stack are coupled together, and wherein each respective manifold stack of said first manifold stack and said second manifold stack includes:

a first multi-channel monolithic structure;

a second multi-channel monolithic structure; and a manifold head connected to said first multi-channel monolithic structure by at least one hole plate located between said manifold head and said first multi-channel monolithic structure, wherein said manifold head includes a plurality of plenum gaps including first plenum gaps and second plenum gaps, said first plenum gaps being for receiving the first fluid and said second plenum gaps being for receiving the second fluid, wherein said manifold head includes a plurality of dividing plates connected in series, each dividing plate of said plurality of dividing plates having a plenum gap of said plurality of plenum gaps located therebetween, said first plenum gaps and said second plenum gaps being located between said dividing plates of said plurality of dividing plates and being arranged in an alternating manner, such that, for each respective dividing plate of said plurality of dividing plates, a respective first plenum gap of said first plenum gaps is located on one side of said dividing plate and a respective second plenum gap of said second plenum gaps is located on another side of said dividing plate, wherein said manifold head includes a first tunnel and a second entry/exit point distributing the first and second fluids separately into and out of said plurality of plenum gaps and into and out of a plurality of channels of said first multi-channel monolithic structure to effect mass and/or heat transfer between the first and second fluids, wherein said first multi-channel monolithic structure includes outer structure walls and inner channel walls defining channel openings of said plurality of channels of said first multi-channel monolithic structure, said channel openings of said plurality of channels being spread over an entire cross-sectional area of said first multi-channel monolithic structure, and said plurality of channels sharing at least a portion of said inner channel walls, wherein said second multi-channel monolithic structure includes outer structure walls and inner channel walls defining channel openings of a plurality of channels of said second multi-channel monolithic structure, said channel openings of said plurality of channels of said second multi-channel monolithic structure being spread over an entire cross-sectional area of said second multi-channel monolithic structure, and said plurality of channels of said second multi-channel monolithic structure sharing at least a portion of said inner channel walls of said multi-channel monolithic structure, wherein said first tunnel of said manifold head includes a first tunnel wall having through slots formed in said plurality of dividing plates for communicating with one or more of said first gaps of said manifold head, wherein said second entry/exit point of said manifold head includes a second wall having through slots formed in said plurality of dividing plates for communicating with one or more of said second plenum gaps of said manifold head, wherein said manifold head is sealed to at least one face of said first multi-channel monolithic structure, where said channel openings are located, wherein said at least one hole plate is sealed between said manifold head and said at least one face of said first multi-channel monolithic structure, wherein each of the first and second fluids is fed separately through said manifold head, such that (i) the first fluid is fed through said first tunnel and said through slots communicating with said one or more first plenum gaps to distribute the first fluid into specific channels of said plurality of channels of said first multi-channel monolithic structure, (ii) the second fluid is fed through said second entry/exit point and said through slots communicating with said one or more second plenum gaps to distribute the second fluid into specific channels of said plurality of channels of said first multi-channel monolithic structure, and (iii) at least one of said inner channel walls of said first multi-channel monolithic structure is common between the first fluid and the second fluid as the first fluid and the second fluid are respectively fed through said first tunnel and said second entry/exit point, wherein said manifold head distributes the first fluid and the second fluid into the specific channels of said first multi-channel monolithic structure in a chessboard configuration via one hole plate, of said at least one hole plate, having a plurality of holes provided between said first multi-channel monolithic structure and said plurality of dividing plates of said manifold head, said one hole plate being configured to distribute the first and second fluids out of or into rows of plenum gaps of said plurality of plenum gaps out of or into the chessboard configuration of channels of said first multi-channel monolithic structure, such that, when one of the first fluid and the second fluid is distributed into a first channel of the specific channels of said first multi-channel monolithic structure, another one of the first fluid and the second fluid is distributed into all channels, of the specific channels of said first multi-channel monolithic structure, which are adjacent to the first channel of the specific channels of said first multi-channel monolithic structure, and wherein said manifold stack includes at least one connector plate or another coupling device connecting said manifold head and/or said first multi-channel monolithic structure to a neighboring manifold head or said second multi-channel monolithic structure.

18. A row of stacks comprising:

a first manifold stack; and a second manifold stack, wherein each respective manifold stack of said first manifold stack and said second manifold stack includes:

a first multi-channel monolithic structure;

a second multi-channel monolithic structure; and a manifold head connected to said first multi-channel monolithic structure by at least one hole plate located between said manifold head and said first multi-channel monolithic structure, wherein said manifold head includes a plurality of plenum gaps including first plenum gaps and second plenum gaps, said first plenum gaps being for receiving the first fluid and said second plenum gaps being for receiving the second fluid, wherein said manifold head includes a plurality of dividing plates connected in series, each dividing plate of said plurality of dividing plates having a plenum gap of said plurality of plenum gaps located therebetween, said first plenum gaps and said second plenum gaps being located between said dividing plates of said plurality of dividing plates and being arranged in an alternating manner, such that, for each respective dividing plate of said plurality of dividing plates, a respective first plenum gap of said first plenum gaps is located on one side of said dividing plate and a respective second plenum gap of said second plenum gaps is located on another side of said dividing plate, wherein said manifold head includes a first tunnel and a second entry/exit point distributing the first and second fluids separately into and out of said plurality of plenum gaps and into and out of a plurality of channels of said first multi-channel monolithic structure to effect mass and/or heat transfer between the first and second fluids, wherein said first multi-channel monolithic structure includes outer structure walls and inner channel walls defining channel openings of said plurality of channels of said first multi-channel monolithic structure, said channel openings of said plurality of channels being spread over an entire cross-sectional area of said first multi-channel monolithic structure, and said plurality of channels sharing at least a portion of said inner channel walls, wherein said second multi-channel monolithic structure includes outer structure walls and inner channel walls defining channel openings of a plurality of channels of said second multi-channel monolithic structure, said channel openings of said plurality of channels of said second multi-channel monolithic structure being spread over an entire cross-sectional area of said second multi-channel monolithic structure, and said plurality of channels of said second multi-channel monolithic structure sharing at least a portion of said inner channel walls of said second multi-channel monolithic structure, wherein said first tunnel of said manifold head includes a first tunnel wall having through slots formed in said plurality of dividing plates for communicating with one or more of said first gaps of said manifold head, wherein said second entry/exit point of said manifold head includes a second wall having through slots formed in said plurality of dividing plates for communicating with one or more of said second plenum gaps of said manifold head, wherein said manifold head is sealed to at least one face of said first multi-channel monolithic structure, where said channel openings are located, wherein said at least one hole plate is sealed between said manifold head and said at least one face of said first multi-channel monolithic structure, wherein each of the first and second fluids is fed separately through said manifold head, such that (i) the first fluid is fed through said first tunnel and said through slots communicating with said one or more first plenum gaps to distribute the first fluid into specific channels of said plurality of channels of said first multi-channel monolithic structure, (ii) the second fluid is fed through said second entry/exit point and said through slots communicating with said one or more second plenum gaps to distribute the second fluid into specific channels of said plurality of channels of said first multi-channel monolithic structure, and (iii) at least one of said inner channel walls of said first multi-channel monolithic structure is common between the first fluid and the second fluid as the first fluid and the second fluid are respectively fed through said first tunnel and said second entry/exit point, wherein said manifold head distributes the first fluid and the second fluid into the specific channels of said first multi-channel monolithic structure in a chessboard configuration via one hole plate, of said at least one hole plate, having a plurality of holes provided between said first multi-channel monolithic structure and said plurality of dividing plates of said manifold head, said one hole plate being configured to distribute the first and second fluids out of or into rows of plenum gaps of said plurality of plenum gaps out of or into the chessboard configuration of channels of said first multi-channel monolithic structure, such that, when one of the first fluid and the second fluid is distributed into a first channel of the specific channels of said first multi-channel monolithic structure, another one of the first fluid and the second fluid is distributed into all channels, of the specific channels of said first multi-channel monolithic structure, which are adjacent to the first channel of the specific channels of said first multi-channel monolithic structure, wherein said manifold stack includes at least one connector plate or another coupling device connecting said manifold head and/or said first multi-channel monolithic structure to a neighboring manifold head or said second multi-channel monolithic structure, and wherein a sealing ring and two different types (type A and B) of end covers of said respective manifold head of one manifold stack of said first manifold stack and said second manifold stack connect said respective manifold head of the one manifold stack of said first manifold stack and said second manifold stack with said respective manifold head of another manifold stack of said first manifold stack and said second manifold stack.

* * * * *